US005562146A

United States Patent [19]

Harmon et al.

[11] Patent Number: 5,562,146

[45] Date of Patent: Oct. 8, 1996

[54] METHOD OF AND APPARATUS FOR FORMING A UNITARY HEAT SINK BODY

[75] Inventors: Ronald A. Harmon, Hudson; Nanak C. Madan, Lowell, both of Mass.; Donald P. Tremblay, Nashua, N.H.

[73] Assignee: Wakefield Engineering, Inc., Wakefield, Mass.

[21] Appl. No.: 394,183

[22] Filed: Feb. 24, 1995

[51] Int. Cl.[6] ..... B22D 19/00

[52] U.S. Cl. ..... 164/112; 164/333

[58] Field of Search ..... 164/112, 332, 164/333, 334

[56] References Cited

U.S. PATENT DOCUMENTS

| | | | |
|---|---|---|---|
| 4,369,838 | 1/1983 | Asanuma et al. | 165/185 |
| 4,899,210 | 2/1990 | Lorenzetti et al. | 357/81 |
| 5,215,140 | 6/1993 | Beane | 164/65 |
| 5,302,853 | 4/1994 | Volz et al. | 257/707 |

FOREIGN PATENT DOCUMENTS

| | | | |
|---|---|---|---|
| 4-228251 | 8/1992 | Japan | 164/112 |

*Primary Examiner*—Joseph J. Hail, III
*Assistant Examiner*—I.-H. Lin
*Attorney, Agent, or Firm*—Blodgett & Blodgett, P.C.

[57] ABSTRACT

A method of forming a unitary heat sink metal body by supporting one end of each plurality of flat metal plates or fins in a row so that the plates are spaced and parallel and casting a base about the freely extending ends of the plates. More specifically, the base is formed by die casting. Apparatus for carrying out the above method is also provided which includes a fixed base and a support for supporting a plurality of flat metal plates or fins in spaced parallel relationship so that one end of each plate engages the fixed base and the opposite end of each plate extends freely from the support. The freely extending ends of the plates are positioned within the cavity of a mold such as a die cast mold. The cavity of the mold is filled with molten metal for filling the spaces between the freely extending ends of the plates and forming the base of the heat sink when the molten metal solidifies.

40 Claims, 20 Drawing Sheets

METHOD OF AND APPARATUS FOR FORMING A UNITARY HEAT SINK BODY

BACKGROUND OF THE INVENTION

The present invention is generally directed to a method of forming a heat sink device for dissipation of thermal energy which is generated by electronic devices such as semiconductors and generally directed to the apparatus for carrying out the method. The present invention is more specifically directed to a method of and apparatus for forming a heat sink device which consists of a solid base portion and a plurality of spaced parallel cooling fins which are fixed to the base and which extend transversely of one broad surface of the base.

Many types of electronic devices generate heat during their operation. This heat must be dissipated to avoid damage to the device. Some of these electronic devices have power-handling limitations due to their inability to dissipate internally-generated heat. A heat sink is any body of metal or equivalent material which is placed in contact with an electronic device for absorbing heat from the device and for dissipating the heat to the atmosphere by convection and/or radiation.

As a rule, heat sinks are constructed of metals which have a high coefficient of thermal conduction such as aluminum and copper and alloys of these two metals. The heat sinks are formed into shapes which are conducive to a high rate of conductive and convection of heat.

The most commonly used type of heat sink consists of a generally rectangular solid base and a plurality of spaced parallel fins which are fixed to the base and which extend transversely of one broad surface of the base. The opposite broad surface of the base is applied to the electronic device to be cooled. The heat sink is mechanically attached to an electronic device by a clamping device such as a resilient spring clip.

Heat sinks of the type described above are made in a number of ways. The heat sink can be made by extruding a continuous strip having the desired heat sink configuration and then severing individual heat sink units from the extrusion. This method has severe limitations with respect to fin height, fin thickness and fin density. Another method of forming the heat sink is to machine the fins from a solid block of metal. This method is labor intensive, time consuming and expensive. These and other difficulties experienced with the prior art devices have been obviated by the present invention.

It is, therefore, a principle object of the invention to provide a method of forming a heat sink body by casting a base to one end of a row of spaced parallel plates or fins.

Another object of the invention is the provision of a method of forming a heat sink body by die casting a base to one end of a row of spaced parallel plates or fins.

A further object of the present invention is the provision of apparatus for casting a heat sink base to one end of a row of spaced parallel plates or fins.

It is another object of the present invention to provide apparatus for die casting a base onto one end of a row of spaced parallel plates or fins.

A still further object of the invention is the provision of apparatus for die casting a base directly onto one end of a row of parallel spaced fins which is adjustable for a range of fin heights.

It is a further object of the invention to provide a heat sink which is formed by casting a solid base to one end of a group of parallel spaced plates.

With these and other objects in view, as will be apparent to those skilled in the art, the invention resides in the combination of parts set forth in the specification and covered by the claims appended hereto.

SUMMARY OF THE INVENTION

In general, the invention consists of a method of forming a unitary heat sink body by casting a solid metal base onto one end of a group of parallel spaced plates. More specifically, the method includes the steps of supporting one end of each plurality of flat metal plates or fins in a row so that the plates are spaced and parallel, positioning the freely extending opposite ends of the plates within the open cavity of a die casting mold, providing a seal between and around plates so that the cavity is completely sealed by the seal and plates, injecting molten metal into the cavity so that the free ends of the plates are immersed in the molten metal and removing the completed unitary heat sink metal body from the cavity after the molten metal has been allowed to solidify. The invention also consists of apparatus for carrying out the above method which includes a fixed base and means for supporting a plurality of flat plates or fins in spaced parallel relationship so that one end of each plate engages the fixed base and the opposite end of each plate extends freely from the support means. A die cast mold which has a cavity is moved toward the fixed base so that the free ends of the plates extend into the cavity and the opening to the mold is sealed by the support means and the plates. When molten metal is injected into the cavity, it flows into the spaces between the freely extending ends of the plates and forms the base of the heat sink when the molten metal hardens.

BRIEF DESCRIPTION OF THE DRAWINGS

The character of the invention, however, may be best understood by reference to one of its structural forms, as illustrated by the accompanying drawings, in which.

DETAILED DESCRIPTION OF A FIRST EMBODIMENT OF THE INVENTION

Figure 1:
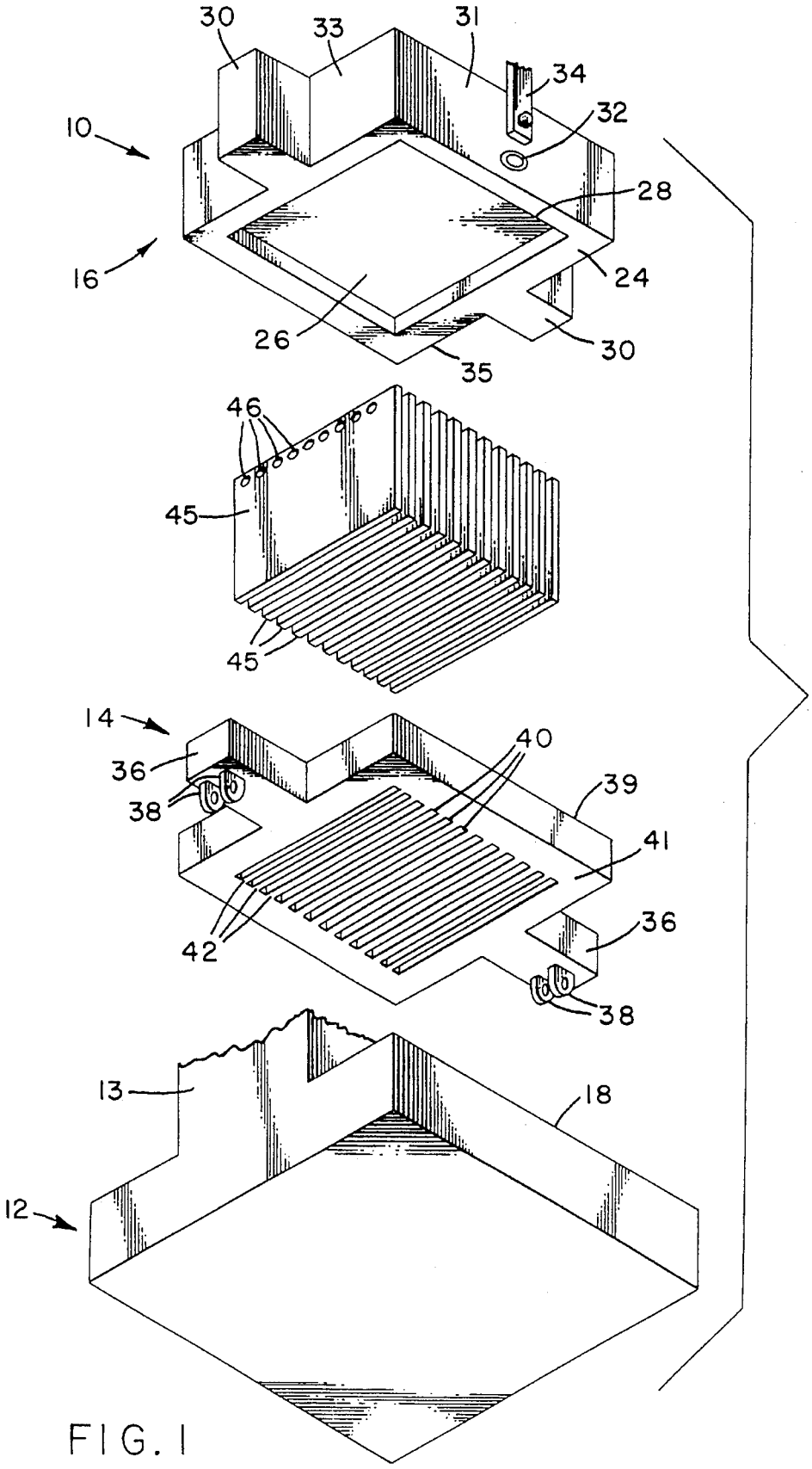
FIG. 1 is an exploded isometric view of the components of a first embodiment of an apparatus embodying the principles of the present invention for forming a heat sink.
Figure 2:
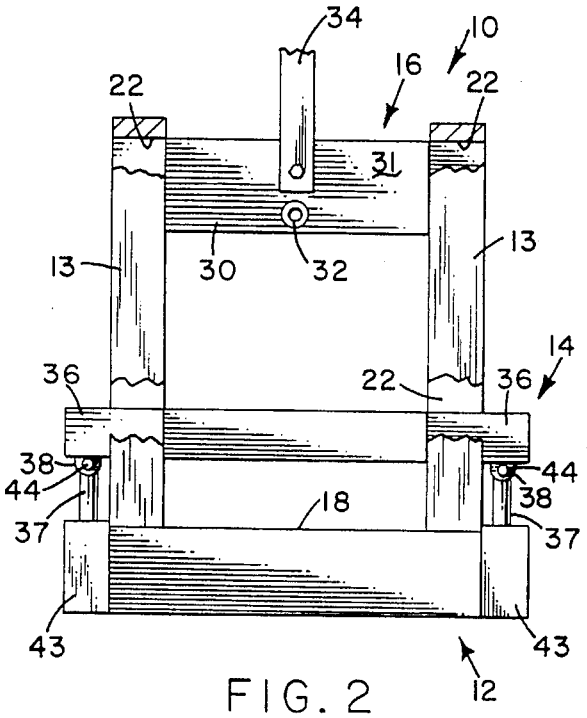
FIG. 2 is a front elevational view of the heat sink forming apparatus of the present invention, prior to insertion of the flat plates which eventually become the cooling fins of the heat sink.

Referring first to FIGS. 1 and 2, a first embodiment of a heat sink forming apparatus of the present invention is generally indicated by the reference numeral and comprises a fixed base which is generally indicated by the reference numeral 12, a spacing and sealing plate which is generally indicated by the reference numeral 14, a die cast mold which is generally indicated by the reference numeral 16, and a pair of vertical guide rails 13 which are fixed to the base 12 for guidingly supporting the spacing and sealing plate 14 and the die cast mold 16.

The fixed base 12 has a flat upper surface 18. The guide rails 13 are fixed to the base 12 and extend vertically from the surface 18 in an aligned spaced relationship. Each guide rail 13 has a groove 22 which faces the opposite guide rail.

Figure 4:
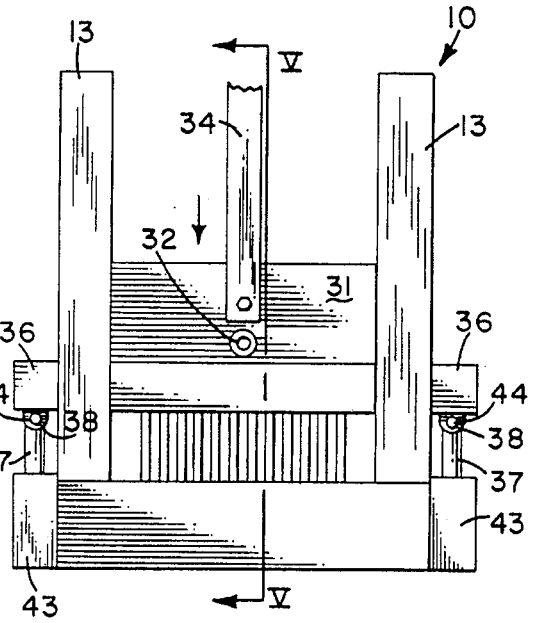
FIG. 4 is a front elevational view of the apparatus, showing the mold in the active casting position relative to the plates.

The die cast mold 16 has a bottom surface 24, a rectangular die cavity 26, and an opening 28 in the surface 24 to the die cavity. One of the side surfaces of the mold, indicated by the reference numeral 31, has an injection opening 32 to the cavity 26. The die cast opening 32 is a conventional opening for interacting with conventional die casting apparatus, not shown, for injecting molten metal into the mold 16. A pair of projections 30 are fixed to a pair of opposite side surfaces 33 and 35 of the mold 16. The projections 30 extend horizontally from the surfaces 33 and 35 into the grooves 22 of the guide rails 13 for guiding the mold 16 for vertical motion from an inactive position as shown in FIG. 2 toward the surface 39 of the spacing and sealing plate 14 to an active molding position as shown in FIG. 4. The vertical movement of the mold 16 is controlled by a positive drive mechanism, not shown, which is connected to the mold 16 by connecting arms 34.

The spacing and sealing plate 14 has a pair of horizontally extending projections 36 which extend through the slots 22 for guiding the plate 14 vertically relative to the surface 18. The plate 14 is maintained in a stationary position for a particular molding operation. However, the plate 14 may be adjusted vertically for a purpose to be described. The vertical adjustment of the plate 14 is accomplished by pistons 37 which are driven by fluid actuators 43 at opposite end of the base 12. The pistons 37 are connected to brackets 38 which are fixed to the projections 36. The spacing and sealing plate 14 has a plurality of spaced parallel slots 40 which define a plurality of spaced ribs 42. The slots 40 are adapted to receive flat plates 45 which are destined to become the cooling fins of the heat sink which is to be formed by the apparatus. Each plate 45 has a plurality of apertures 46 adjacent to one edge of the plate as shown in FIG. 1.

Figure 3:
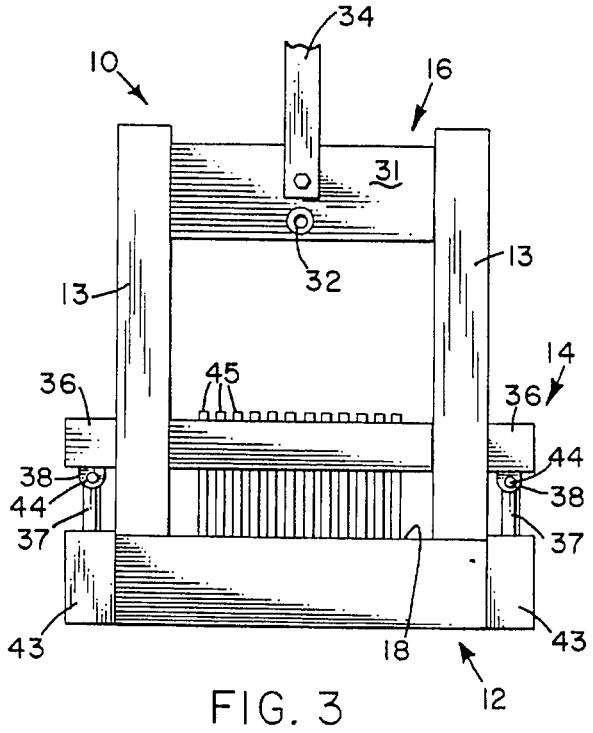
FIG. 3 is a front elevational view of the apparatus after insertion of the plates in the guide means.
Figure 5:
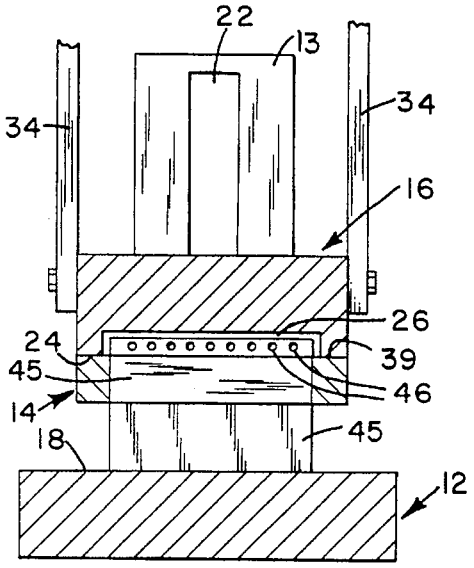
FIG. 5 is a vertical cross-sectional view of the apparatus, taken along the line V—V of FIG. 4 and looking in the direction of the arrows.
Figure 6:
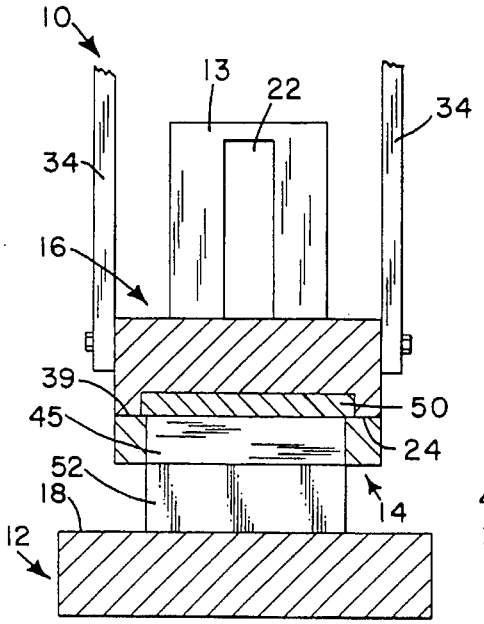
FIG. 6 is a vertical cross-sectional view similar to FIG. 5, showing the mold in its active position after molten metal has been injected into the mold cavity and allowed to solidify.
Figure 8:
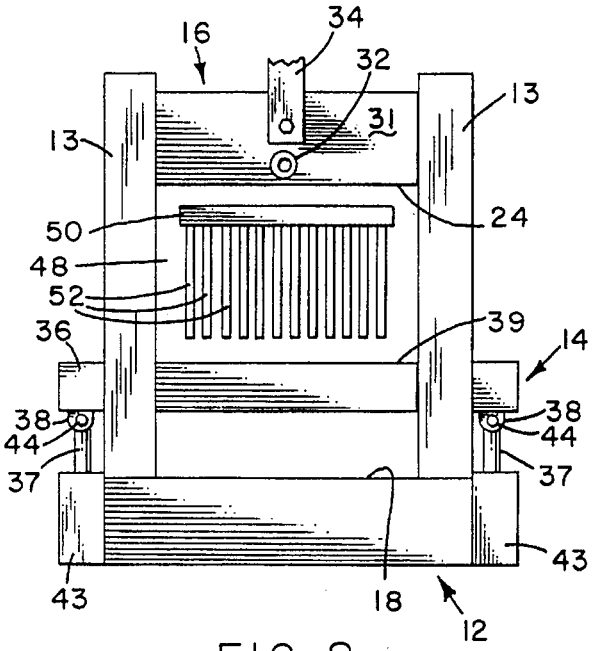
FIG. 8 is a view similar to FIG. 7 showing the heat sink being removed from the guide means.
Figure 7:
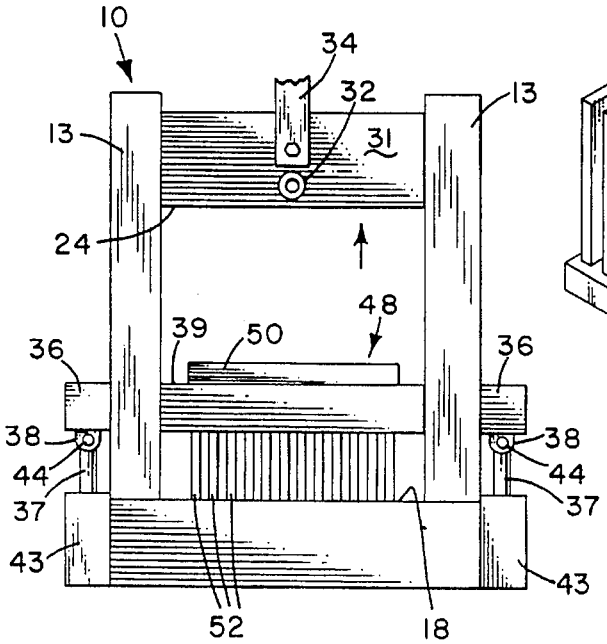
FIG. 7 is a front elevational view of the apparatus of the present invention showing the mold in its inactive position after the heat sink has been formed.
Figure 9:
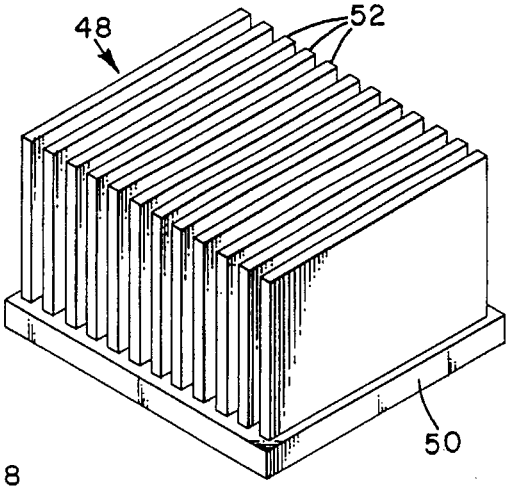
FIG. 9 is an isometric view of a heat sink which is formed by the method and apparatus of the present invention.
Figure 10:
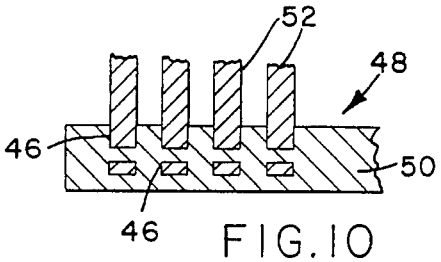
FIG. 10 is a fragmentary vertical cross-sectional view of the heat sink base of FIG. 9 taken through the apertures of the plates which have been filled in by material of the base.

The heat sink, such as that which is shown in FIG. 9, is formed in accordance with the method of the present invention by utilizing apparatus, such as that which is shown in FIGS. 1–7. The heat sink is formed by first positioning a plurality of plates 45 in the slots 40 of the plate 14 so that the bottom edges of the plates rest on the surface 18 of the fixed base 12 and the upper ends of the plates extend freely above the plate 14, as shown in FIG. 3. At this phase of the operation, the die cast mold 16 is in its upper inactive position as shown in FIG. 3. The mold 16 is then lowered to its active position as shown in FIG. 4 by actuating mechanism, not shown, acting through the connecting arms 34. In the preferred method of the present invention, the horizontal dimensions of the die cavity 26 are slightly greater than the horizontal dimensions of the package of plates 45 so that there is a gap at each vertical side edge of each plate as shown in FIG. 5 and also a gap between each end plate in the row of plates and the adjacent vertical wall of the die cavity 26. There is also a gap between the upper edges of the plates 45 and the upper wall of the die cavity 26, as also shown in FIG. 5. The upper surface 39, the plates 45 and ribs 42, taken together, form a complete seal at the opening 28 to the die cavity. Molten metal is then injected into the die cavity through the injection opening 32 to fill the spaces around and between the freely extending ends of the plates 45 and also into the apertures 46. The molten metal is then allowed to solidify as shown in FIG. 6. After solidifying of the molten metal within the cavity 26, the die east mold 16 is moved to its upper inactive position as shown in FIG. 7. This enables the completed heat sink, generally indicated by the reference numeral 48, to be removed from the plate 14 as shown in FIG. 8. Referring specifically to FIG. 9, the completed heat sink 48 includes a generally rectangular base 50 and a plurality of spaced parallel cooling fins 52 which extend transversely from one broad surface of the base 50. As shown in FIG. 10, one end of each plate 45 which defines one of the fins 52 is completely embedded within the base 50. The apertures 46 of each plate which are filled with material of the base, provides a mechanical interlocking between the base and each of the plates 45.

At the time of injection of molten material into the cavity 26, all of the components of the molding assembly are in a fixed position. This includes the base 12, the plate 14, and the mold 16. All of the components of the molding assembly are capable of maintaining a fixed posture against the very high pressure which is associated with die casting of molten metal. However, the elements of the molding apparatus can be adjusted to accommodate plates of different heights. The plate 14 can be raised or lowered by the fluid actuators 43 to accommodate shorter or longer plates. The actual operating position of the plate 14 will be determined by how much of the upper end of each plate is to extend above the upper surface 39 of the plate. The actuating position of the die cast mold 16 can also be adjusted by the use of pneumatic or hydraulic drive actuators, such as the fluid actuators 43 or by any other known adjustable positive drive mechanism. The lower active position of the die mold will be determined by the upper edges of the plates within the frame 14 and the desired gap between the upper edges of the plates and the upper surface of the cavity 26.

SECOND EMBODIMENT OF A HEAT SINK FORMING APPARATUS

Figure 11:
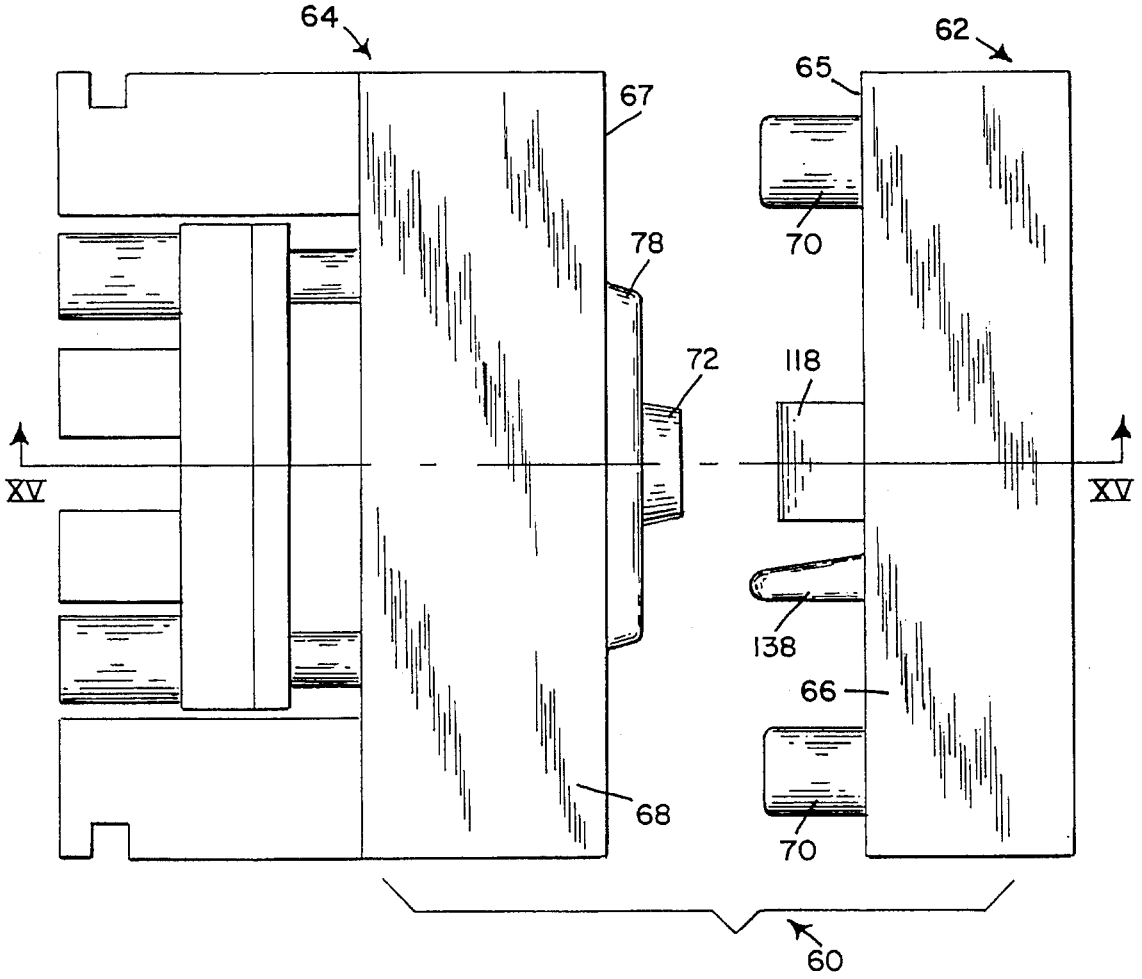
FIG. 11 is a top plan view of a second embodiment of die casting apparatus for forming a heat sink, shown in the open position.
Figure 12:
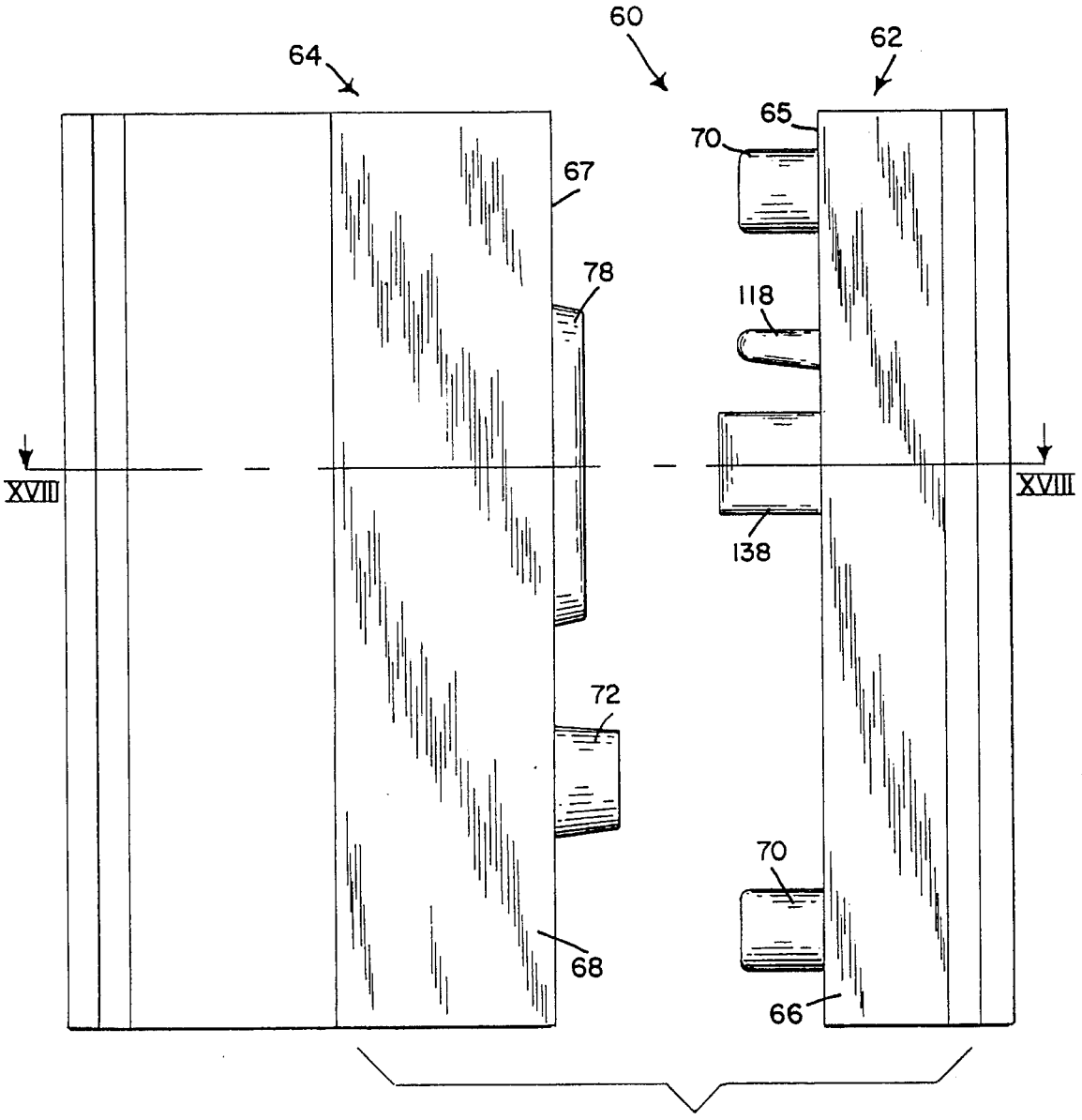
FIG. 12 is a side elevational view of the second embodiment.
Figure 13:
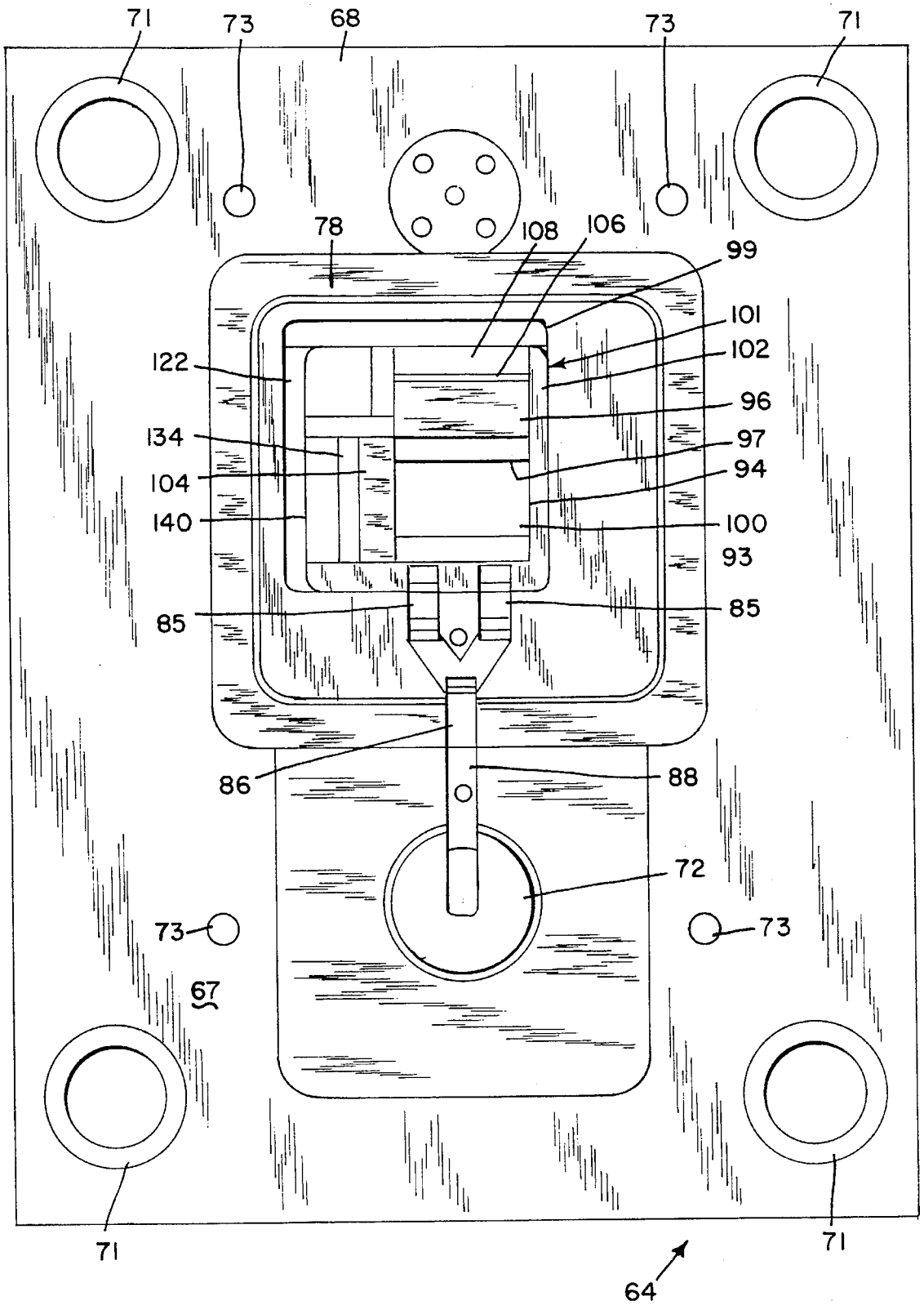
FIG. 13 is an elevational view of the face portion of the ejector half of the second embodiment, looking in the direction of arrow XIII of FIG. 11.
Figure 14:
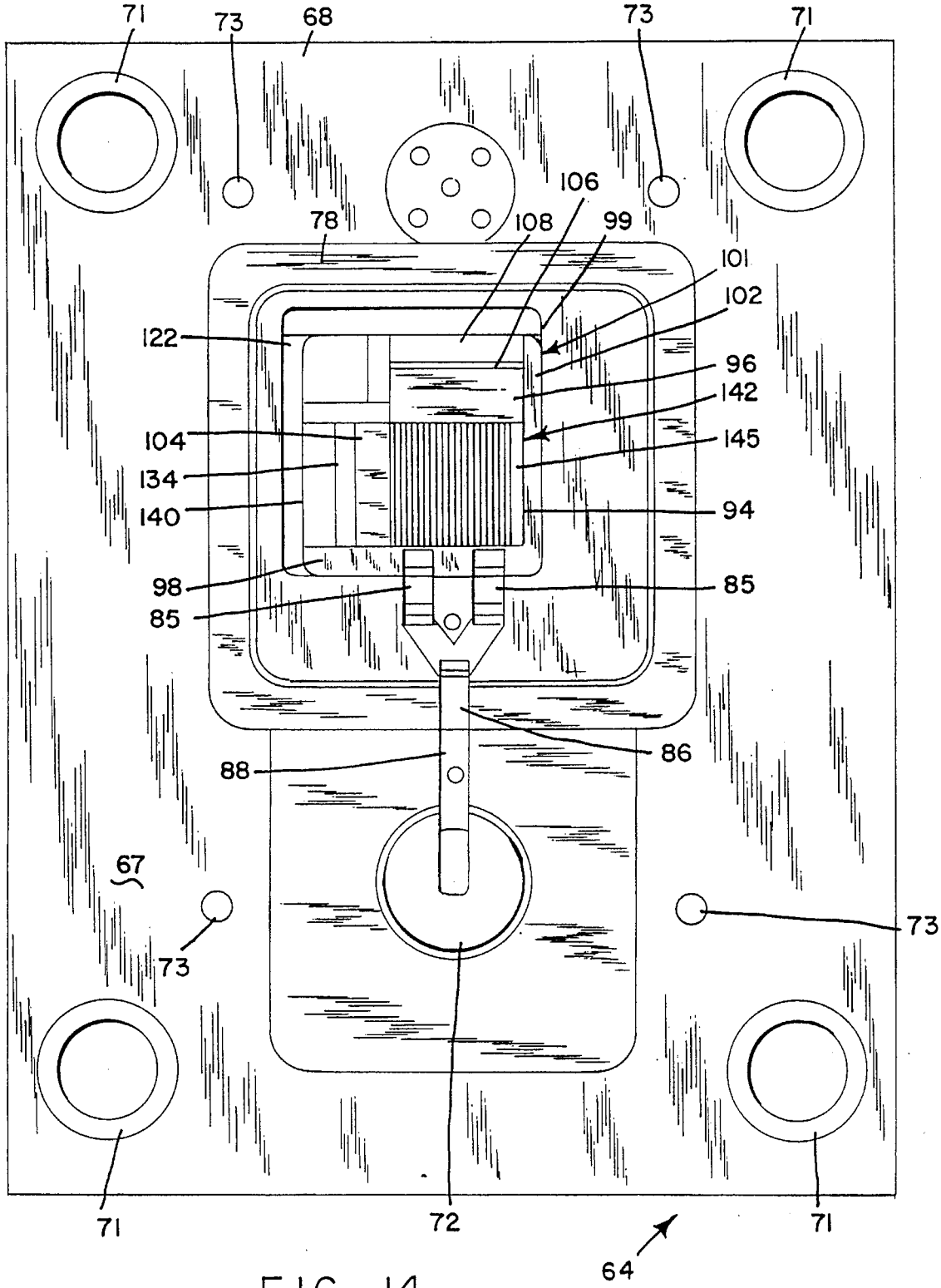
FIG. 14 is identical to FIG. 13 except that it includes a plate cartridge which is positioned in the ejector half of the die for presentation to the cover half portion of the die.
Figure 15:
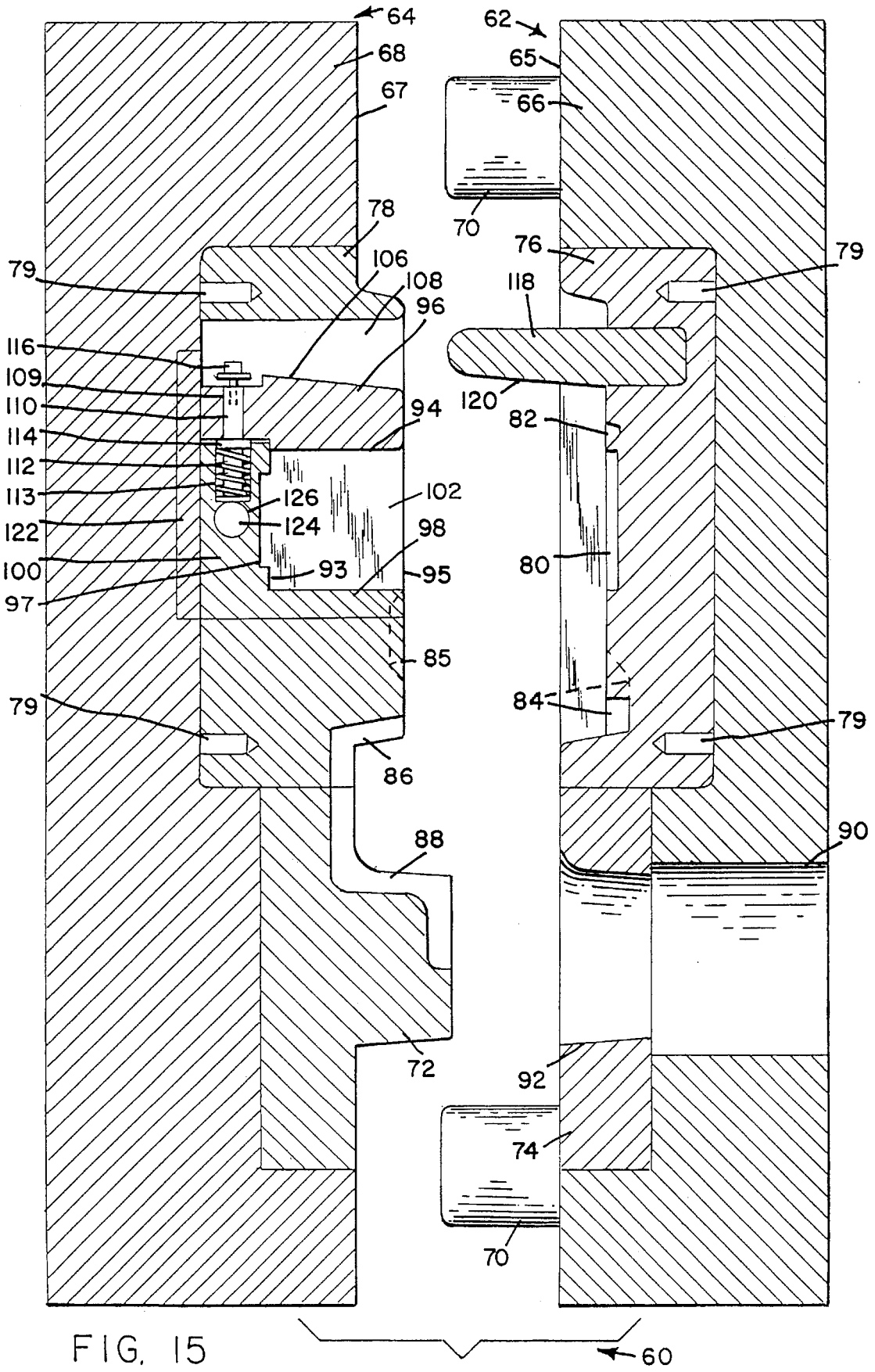
FIG. 15 is a vertical cross-sectional view of the second embodiment, taken along line XV—XV of FIG. 11 and looking in the direction of the arrows.
Figure 16:
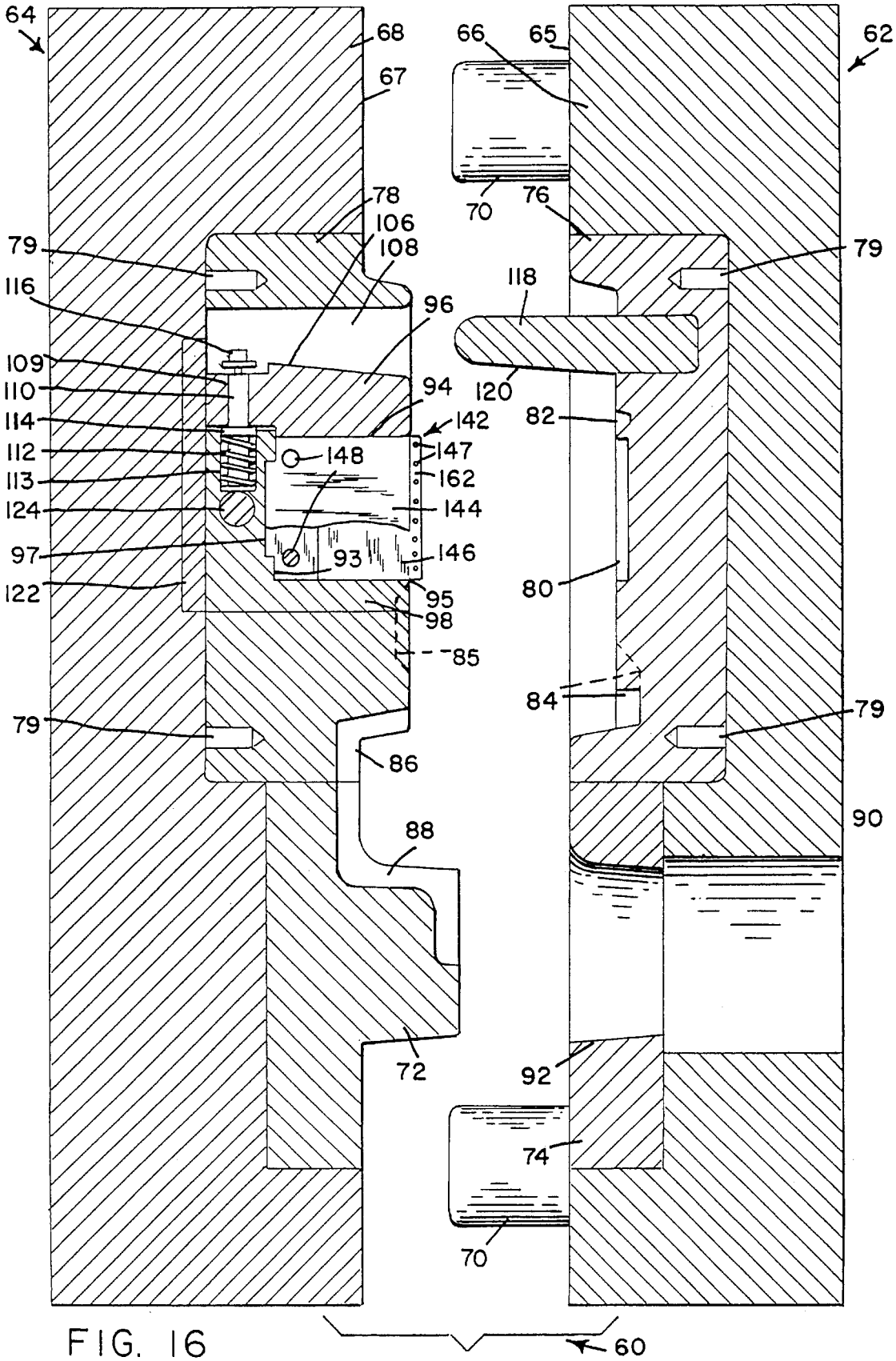
FIG. 16 is identical to FIG. 15 except that it includes the plate cartridge which is positioned in the ejector half portion of the die.
Figure 17:
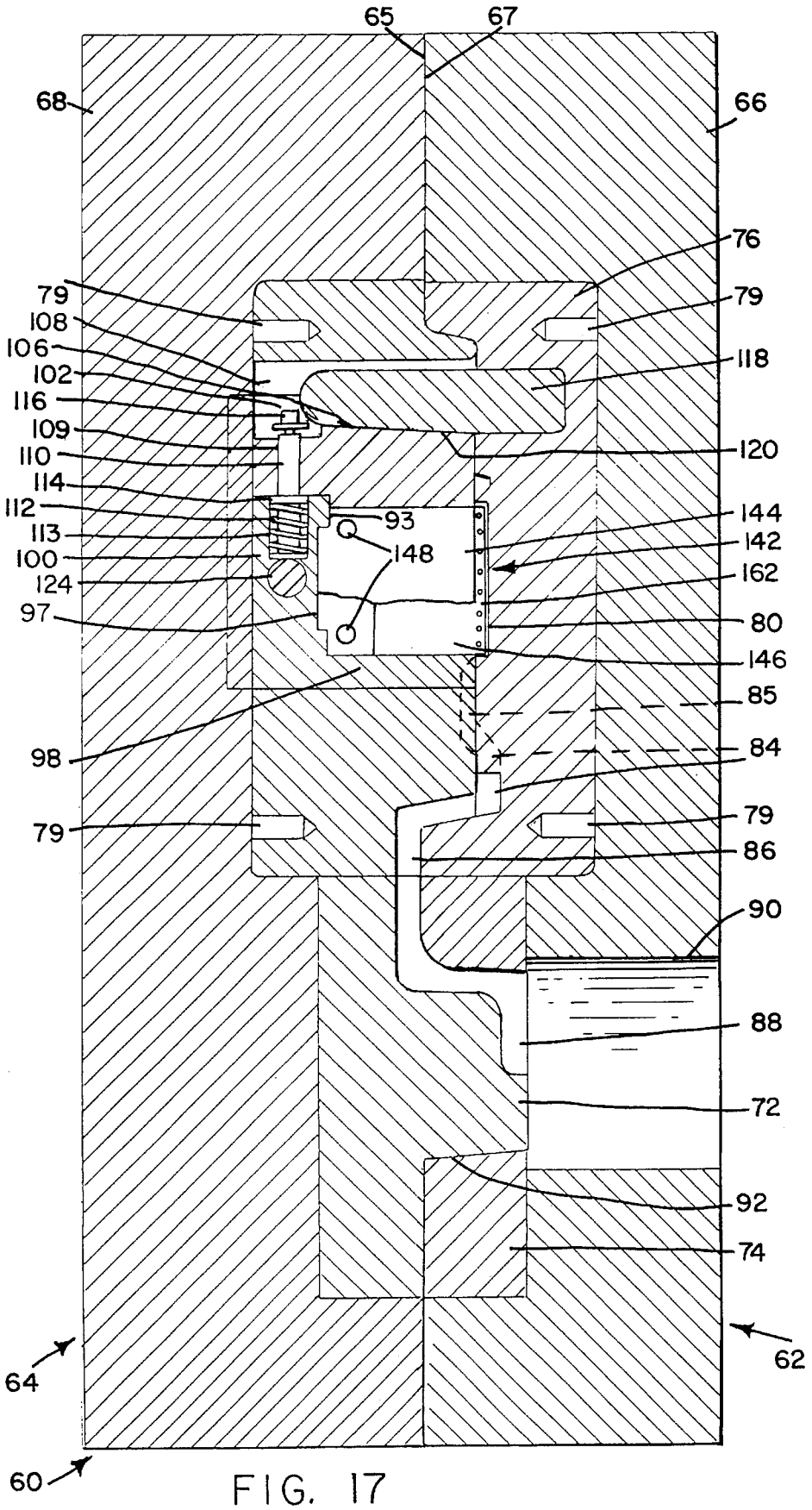
FIG. 17 is similar to FIG. 16 except that the ejector and cover half portions of the die are shown in a closed position.

Referring first to FIGS. 11 and 12, a second embodiment of a heat sink forming apparatus of the present invention consists of an injection die apparatus which is generally indicated by the reference numeral 60. Apparatus 60 comprises a first die member which is generally indicated by the reference numeral 62 and a second die member which is generally indicated by the reference numeral 64. The first die member 62 is generally referred to in die casting industry as the cover half of the die and the second die member 64 is generally referred to in the die casting industry as the ejector half of the die. The first die member or "cover half" is normally stationary and the second die member or "ejector half" is mounted for movement toward and away from the first die member by conventional supporting and driving apparatus, not shown, between an open position shown in FIGS. 11 and 12 to a closed position which is shown in FIG. 17. When the die is in the open position, the opposing face surfaces 65 and 67 of the first and second die members 62 and 64, respectively, are spaced from one another. When the die is in the closed position, the face surfaces 65 and 67 abut, as shown for example in FIG. 17. The second die member includes a plurality of return pins 73 at the face surface 67 to assist in the separation of the die members after a die casting operation. The first die member 62 includes a plurality of guide pins 70 which extend from the face surface 65 for mating with a plurality of bushings 71 in the second die member 64 at the face surface 67.

Referring to FIGS. 11–15, the first die member 62 includes a conventional base portion 66 and a first cavity insert 76. The second die member 64 includes a conventional base portion 68 and a second cavity insert 78. The cavity inserts 76 and 78 are connected to their respective base portions by screws 79.

The face surface 65 has a recessed portion 77 which contains a cavity 80 and an overflow cavity 82 which is located just above the injection cavity 80. A runner portion 84 is located below and spaced from the injection cavity 80.

The second cavity insert 78 has spaced runner portions 85 and 86 in the face surface 67 and a socket 94 in the face surface 67 which faces the injection cavity 80. The base 68 of the second die member 64 includes a shot horn 72 which extends from the die face 67 toward the first die member 62. When the first and second die members 62 and 64, respectively, are in the closed position, the horn 72 enters a bore 92 of the first die member 62. The bore 92 is located in a shot block 74 which forms part of the base portion 66 of the first die member 62. The bore 92 is connected to a bore 90 in the base portion 66. The shot horn 72 includes a runner portion 88 which is connected to the runner portion 86. When the die members 62 and 64 are in the closed position as shown in FIG. 17, the runner portion 84 connects the runner portion 86 to the runner portion 85.

The runner portion 85 is, in turn, connected to the injection cavity 80. During a die casting operation, molten metal is introduced into the bores 90 and 92 by conventional apparatus, not shown, and flows through the runner portions 88, 86, 84, 85 to the injection cavity 80.

Figure 18:
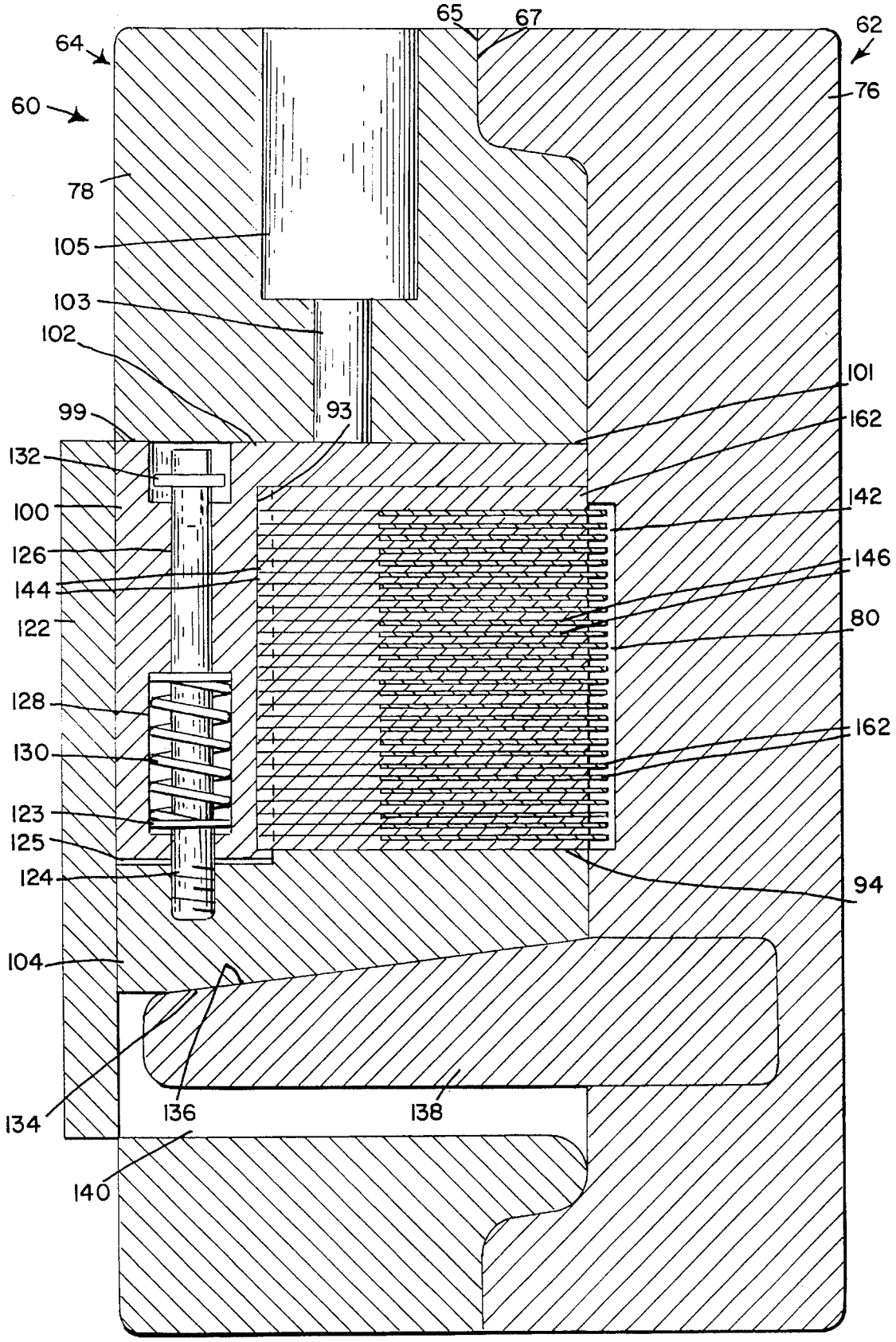
FIG. 18 is a horizontal cross-sectional view of the second embodiment taken along line XVIII—XVIII of FIG. 12 and looking in the direction of the arrows.

Referring to FIGS. 17 and 18, the second cavity insert 78 has a secondary cavity 99 which contains a holder which is generally indicated by the reference numeral 101. The holder can be mounted within the cavity 99 in a fixed position by fasteners or the like. The holder 101 is preferably removably mounted within the cavity 99. There is a small tolerance gap (not shown) between the side wall 102 and the adjacent fixed wall of the cavity insert 78 which is maintained by a piston 103 which is actuated by a pneumatic cylinder 105 to provide a cushioning effect. This function could also be provided by a compression spring. The holder 101 has a generally rectangular socket 94 which is defined by a back wall 100, a top wall 96, a bottom wall 98 and a pair of side walls 102 and 104. The side wall 102, the bottom wall 98 and the back wall 1 00 are integral. The back wall 96 has a forwardly facing surface 93 which has a generally rectangular recess 97. The top wall 96 is mounted for vertical movement relative to the bottom wall 98. The top wall 96 is guided for vertical movement on a guide pin 110 which is fixed to the back wall 100 and which extends through a relatively large bore 113 in the back wall 100 and through a relatively small bore 109 in the top wall 96. A helical compression spring 112 is located in the bore 113. The spring biases the top wall 96 upwardly by engaging a washer 114 which lies between the spring 112 and the top wall 96. An adjustable stop 116 is threaded into the upper end of the guide pin 110. The upper wall 96 has an upper cam surface 106 which slants downwardly toward the first die member 62 at a relatively small angle to the horizontal. The second cavity insert 78 includes an indent 108 which is located above the cam surface 106. A projection 118 is fixed to the first cavity insert 76 and extends toward the indent 108. The projection 118 includes a bottom cam surface 120 which extends at a slight upward angle from the face surface 65 toward the second die member 64. When the die members 62 and 64 are in the closed position, as shown in FIG. 17, the cam surface 120 engages the cam surface 106 and forces the top wall 96 downwardly against the bias of the spring 112. The inner edge of the top wall 96 bears against a wear plate 122. The wear plate 122 is made of a relatively soft material such as bronze and the top wall 96 is made of a relatively hard material such as steel.

Referring to FIGS. 11, 12, 13 and 18, the side wall 104 is mounted within the second cavity insert 78 for horizontal movement relative to the side wall 102 and back wall 100. There is a gap 125 between the side wall 104 and the back wall 100. A guide pin 124 is fixed to the wall 104 and extends through a relatively large bore 128 and through a relatively small bore 126 in the rear wall 100. A helical compression spring 130 is located within the bore 128 and surrounds the guide pin 124. A washer 123 is fixed to the guide pin 124 and bears against the compression spring 130. The spring 130 normally biases the guide rod 124 and the side wall 104 away from the side wall 102. An adjustable stop 132 is threaded into the end of the guide rod 124 which is adjacent the side wall 102. The side wall 104 has an outer cam surface 134 which faces away from the socket 94. The cam surface 134 extends at a relatively small angle from the wear plate 122 toward the socket 94. The cam surface 134 faces an indent 140 in the face surface 67 of the second cavity insert 78. A projection 138 is fixed to the first cavity insert 76 and extends from the face surface 65 of the first cavity insert 76 toward the indent 140. The projection 138 has a cam surface 136 which extends at a relatively small angle away from the socket 94 from the face surface 65 of the first die member 62 toward the second die member 64. When the first and second die members 62 and 64, respectively, are in the closed position as shown in FIG. 18, the projection 138 extends into the indent 140 so that the cam surface 136 of the projection 138 engages the cam surface 134 of the side wall 104 and forces the side wall 104 toward the side wall 102 against the bias of the spring 130. The back wall 100 which is made of a relatively hard material, such as steel, bears against the wear plate 122.

Figure 19:
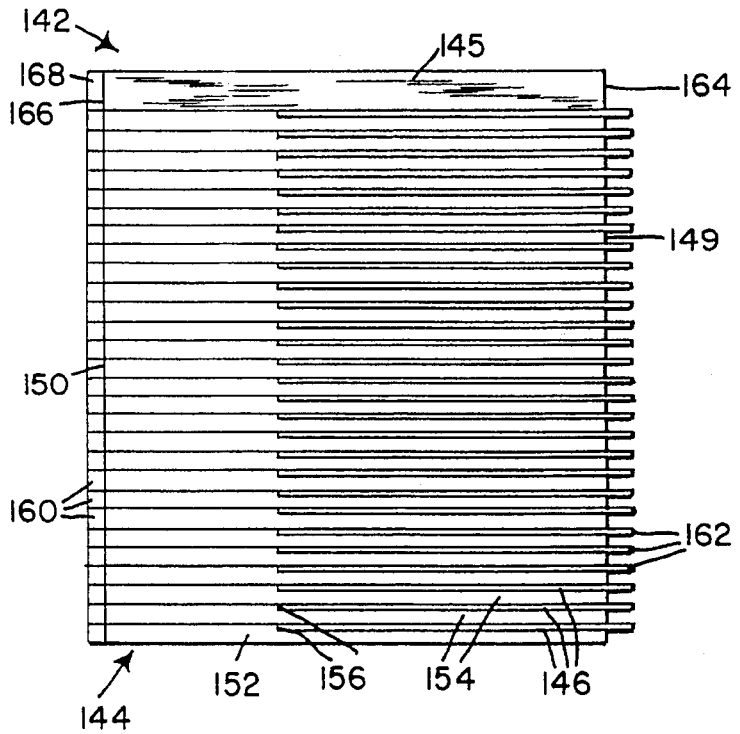
FIG. 19 is a top plan view of a plate cartridge which has been charged with fin plates and which forms part of the second embodiment of the present invention.
Figure 20:
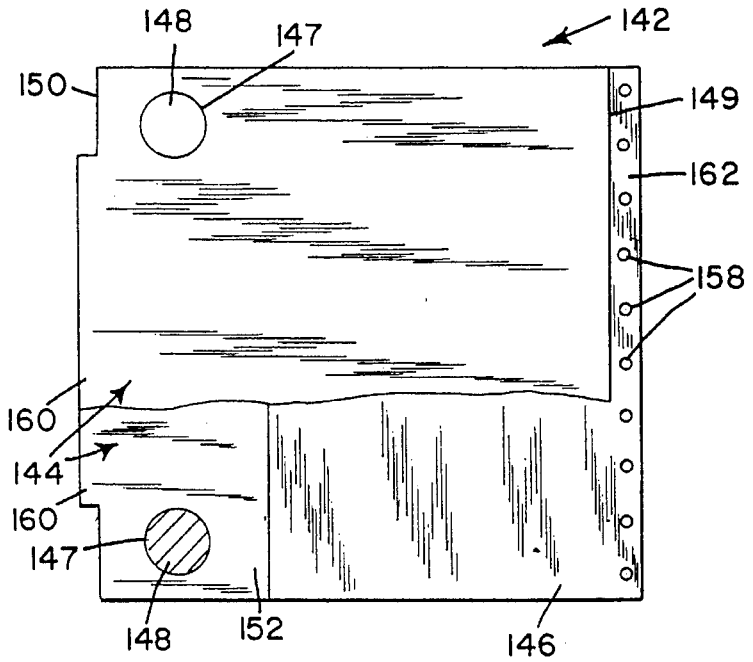
FIG. 20 is a side elevational view of the plate cartridge of FIG. 19.
Figure 21:
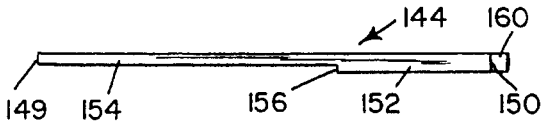
FIG. 21 is a top plan view of one of the spacer plates which make up the plate cartridge of FIG. 19.
Figure 23:
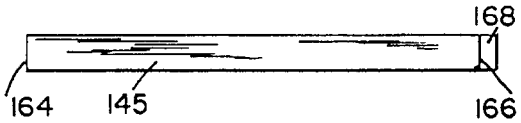
FIG. 23 is a top plan view of an end plate which also forms part of the plate cartridge of FIG. 19.
Figure 22:
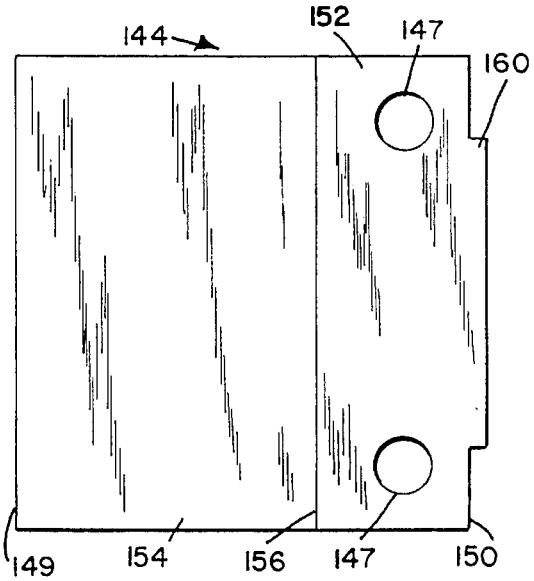
FIG. 22 is a side elevational view of the spacer plate of FIG. 21.
Figure 24:
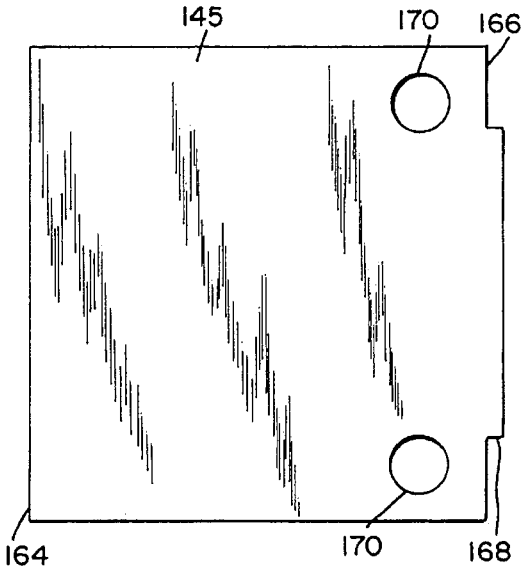
FIG. 24 is a side elevational view of the end plate of FIG. 23.
Figure 25:
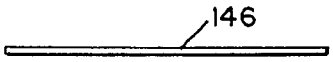
FIG. 25 is a top plan view of one of the fin plates which are combined with the spacer plates to form the plate cartridge of FIG. 19.
Figure 26:
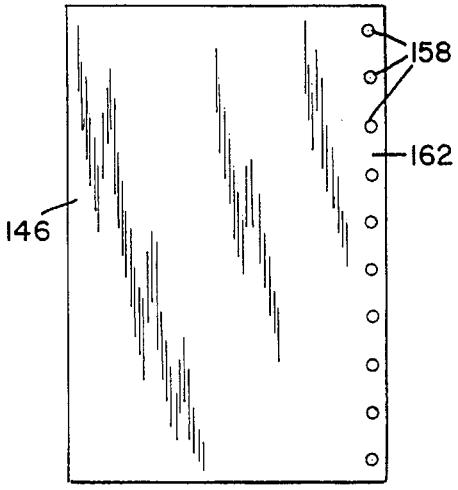
FIG. 26 is a side elevational view of the fin plate of FIG. 25.
Figure 27:
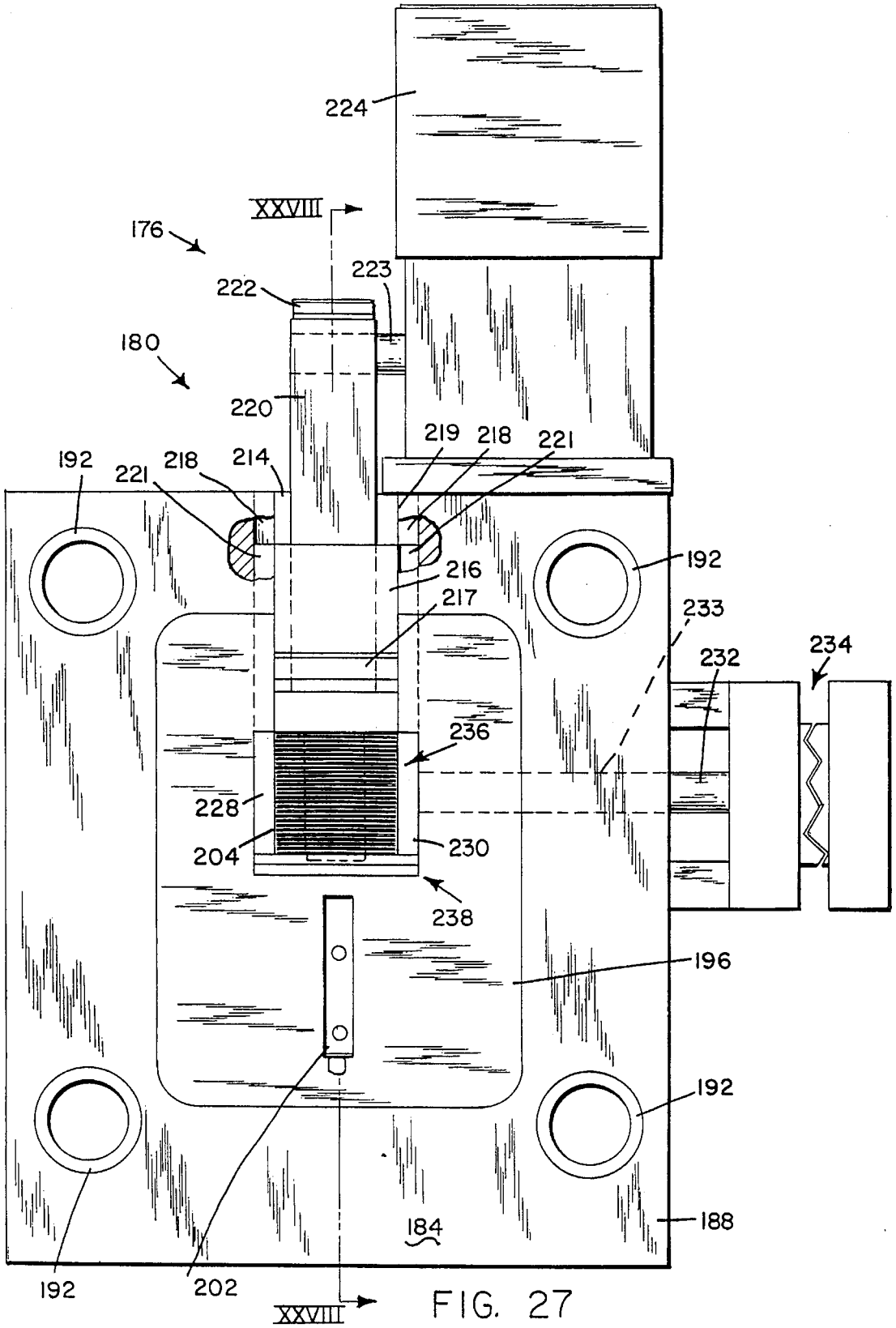
FIG. 27 is an elevational view of the face portion of the ejector half of a third embodiment of die casting apparatus for forming a heat sink in accordance with the present invention.

Referring particularly to FIGS. 19–26, there is shown a plate cartridge, generally indicated by the reference numeral 142, for holding a plurality of fin plates 146 in a row so that the fin plates are spaced and parallel. The plate cartridge 142 comprises a plurality of spacing plates 144 and an end plate 145 which are aligned in a parallel abutting relationship by a pair of retaining pins 148. Each spacing plate 144 is generally planar and has a first end edge 149 at one end of the plate and a second end edge 150 at the opposite end of the plate. The spacing plate 144 has a relatively thick portion 152 and a relatively thin portion 154. The boundary between the relatively thick portion 154 and the relatively thin portion 152 is defined by a transition surface 156 which extends transversely of the general plane of the spacing plate 144 and which faces the first end edge 149. Each spacing plate 144 has a pair of apertures 147 for receiving the retaining pins 148. Each spacing plate 144 has a projecting portion 160 which extends outwardly from the second end edge 150. The end plate 145 is substantially thicker than each of the spacing plates 144 and has a uniform thickness. The end plate 145 is generally planar and has a first end edge 164 and a second end edge 166. A projecting portion 168 extends outwardly from the second end edge 166 and has the same profile as each of the projections 160 of the spacing plates 144. When the end plate 145 and the spacing plates 144 are aligned, as shown in FIGS. 19 and 20, the projecting portions 160 and 168 form a composite rectangular projection. The end plate 145 has a pair of apertures 170 for receiving the retaining pins 148. Each fin plate 146 has a plurality of apertures 158 at one end of the plate. Each spacing plate 144 is coupled with a fin plate 146 by placing the fin plate so that one end edge of the fin plate abuts the transition surface 156 and one broad surface of the fin plate abuts the broad surface of the relatively thin portion 154 of the spacing plate as shown in FIG. 19. After a predetermined number of spacing plates have been coupled with a like number of fin plates, the spacing plates are aligned in a row so that the spacing plates abut and the end plate 145 is placed against the last spacing plate in the row. The retaining pins 148 are inserted through the apertures 170 of the end plate and the apertures 147 of the spacing plates to insure that all of the spacing plates and the end plate are properly aligned. This also insures that the fin plates will also be properly aligned in a parallel spaced relationship as shown in FIG. 19. Each fin plate 146 is slightly wider than the relatively thin portion 154 of the spacing plate so that one end of each fin plate, indicated by the reference numeral 162, extends freely beyond the first end edge 149 of the spacing plate. The freely extending end 160 of the fin plate contains the apertures 158. The relatively thick portion 152 of the spacing plate 144 is equal to the combined thicknesses of the relatively thin portion 154 of the spacing plate 144 and the fin plate 146.

Referring particularly to FIGS. 14 and 16–18, after the plate cartridge 142 has been charged with fin plates 146 as described above, it is inserted through the opening 95 into the socket 94 so that the projecting portions 160 of the spacing plates 144 and the projecting portion 168 of the end plate 145 extend into the recess 97 of the back wall surface 93. The projecting portions 162 of the fin plates 146 extend beyond the face surface of the second cavity insert 78 so that when the second die member 64 is moved toward the first die member 62, to the closed position as shown in FIG. 17, the projecting portions 160 of the fin plates 146 extend into the injection cavity 80 as shown in FIG. 17. As the second die member 64 is moved from the open position to the closed position, the projection 118 enters the indent 108 so that the cam surface 120 of the projection 118 engages the cam surface 106 of the top wall 96 and forces the top wall downwardly against the plate cartridge 142. The projection 118 and the top wall 96 constitute first clamping means for applying pressure to the fin plates along the plane of each fin plate when the plate cartridge 142 is located within the socket 94. Also, when the second die member 64 is moved to the closed position, the projection 138 extends into the indent 140 so that the cam surface 136 of the projection 138 engages the cam surface 134 of the side wall 104. This forces the side wall 104 toward the side wall 102 to compress the plate cartridge 142 between the side walls 102 and 104. The projection 138 and the side wall 104 constitute second clamping means for applying pressure to the fin plates transversely to the plane of each fin plate when the plate cartridge 142 is located within the socket 94.

After a plate cartridge 142 has been charged with fin plates 146 and inserted into the socket 94 of the second die member 64, the second die member is moved to its closed position relative to the first die member 62 as shown in FIG. 17. Molten metal is then introduced into the shot sleeve bore 90 by conventional die casting apparatus in accordance with conventional die casting procedures. The molten metal flows through the runner portions to the injection cavity 80, wherein the molten metal fills the spaces between the fin plates 146 and the apertures 147 of the fin plates. Preferably, the free ends of the fin plates 146 are spaced from the back surface of the injection cavity 80 so that this space is also filled with the molten metal. After the metal which has been injected into the cavity 80 has solidified, the second die member 64 is moved away from the first die member 62 to its open position. Thereafter, the plate cartridge 142 is removed from the socket 94 and the finished heat sink is removed from the plate cartridge 142. The fin plates 146 constitute the fins of the finished heat sink which are embedded in the metal which has been injected into the cavity 80 and which constitutes the base portion of the heat sink. The finished heat sink product for this embodiment is identical to that which is shown in FIGS. 9 and 10 for the first embodiment. The second embodiment of this invention as described above is the preferred embodiment.

THIRD EMBODIMENT OF THE HEAT SINK FORMING APPARATUS

Figure 28:
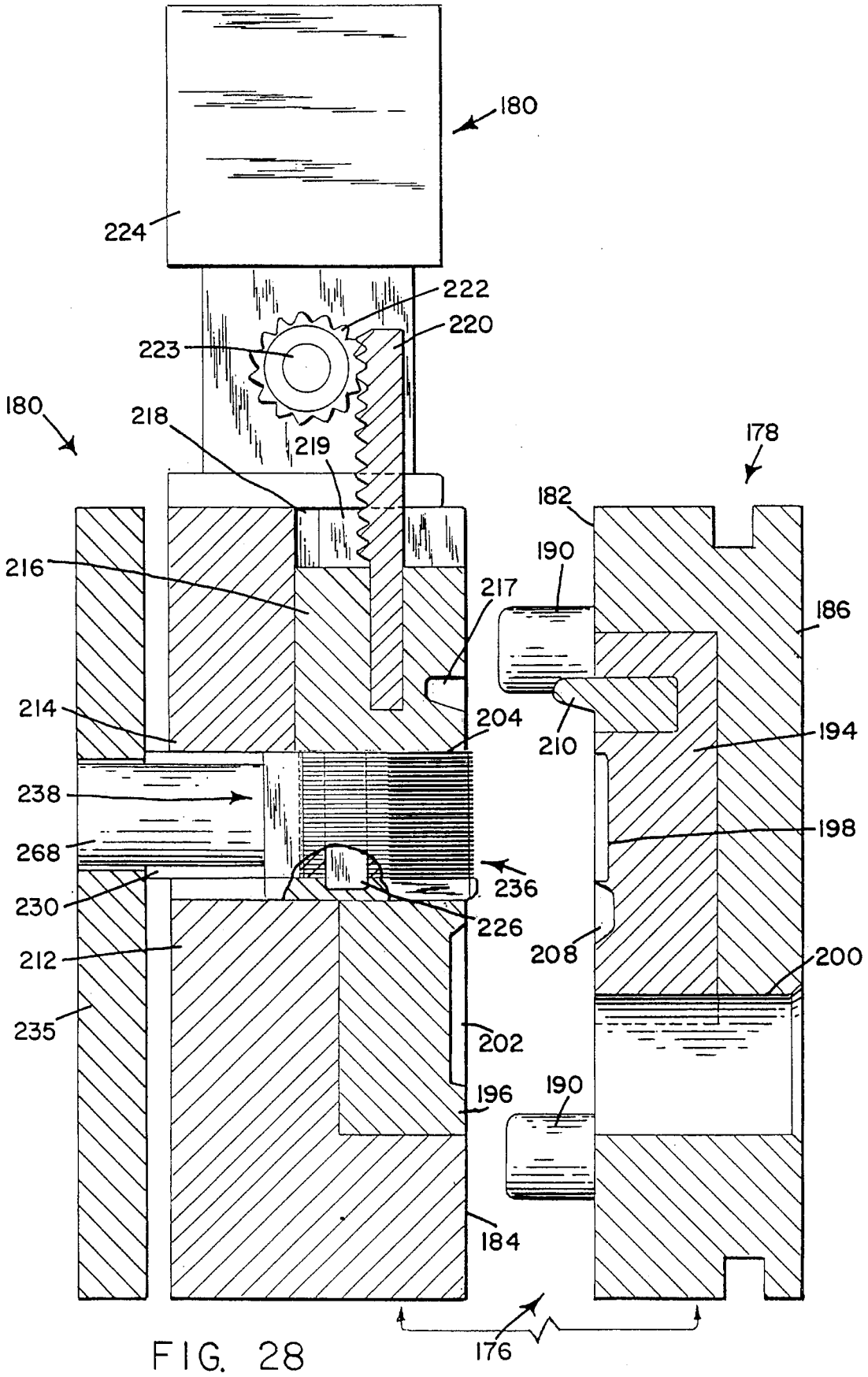
FIG. 28 is a vertical cross-sectional view of the third embodiment taken along the line XXVIII—XXVIII of FIG. 27 and also showing the cover half of the die casting apparatus.
Figure 29:
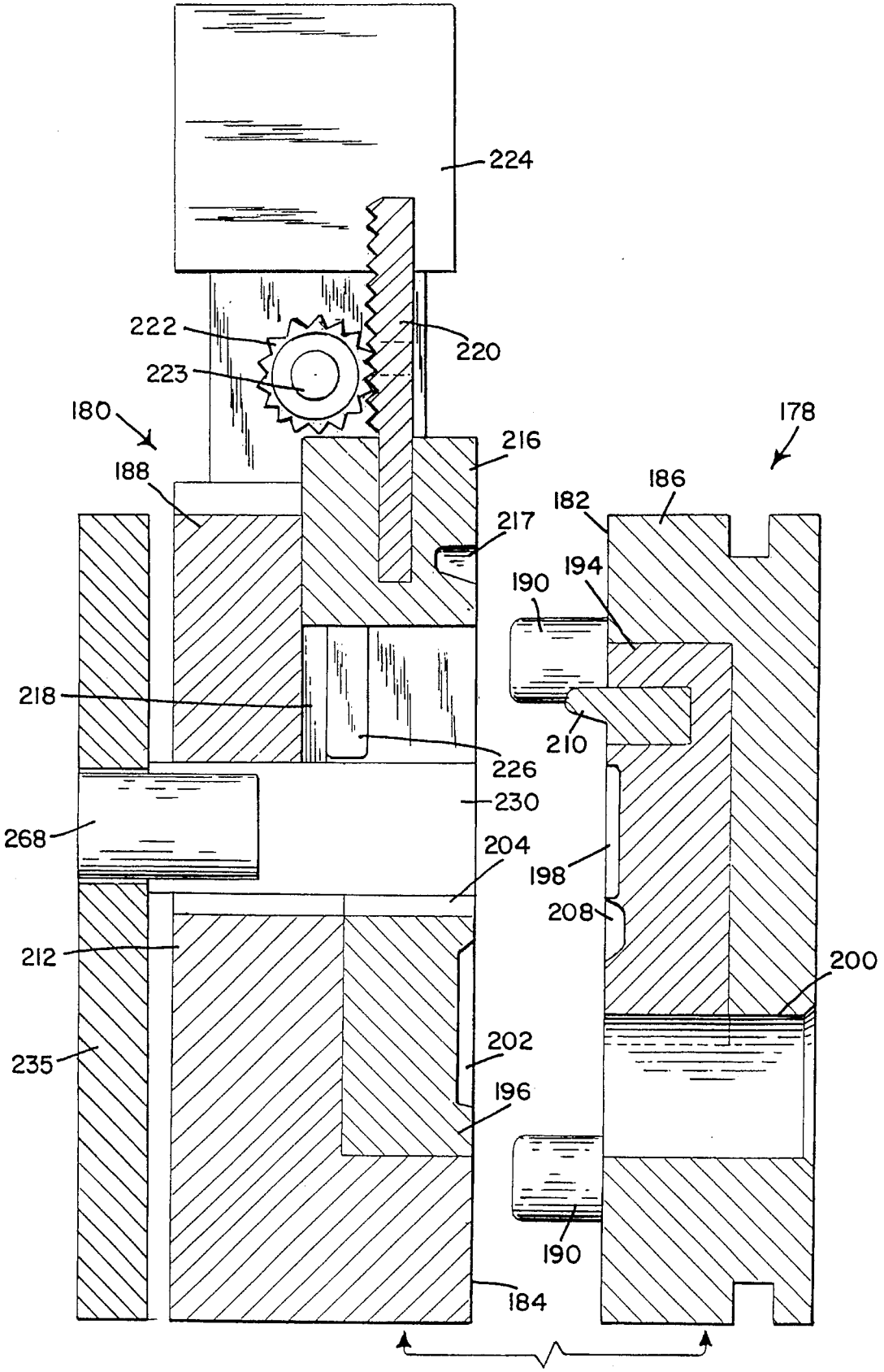
FIG. 29 is a view similar to FIG. 28 showing the die casting apparatus prior to insertion of the plate cartridge in the ejector half of the die casting apparatus.
Figure 30:
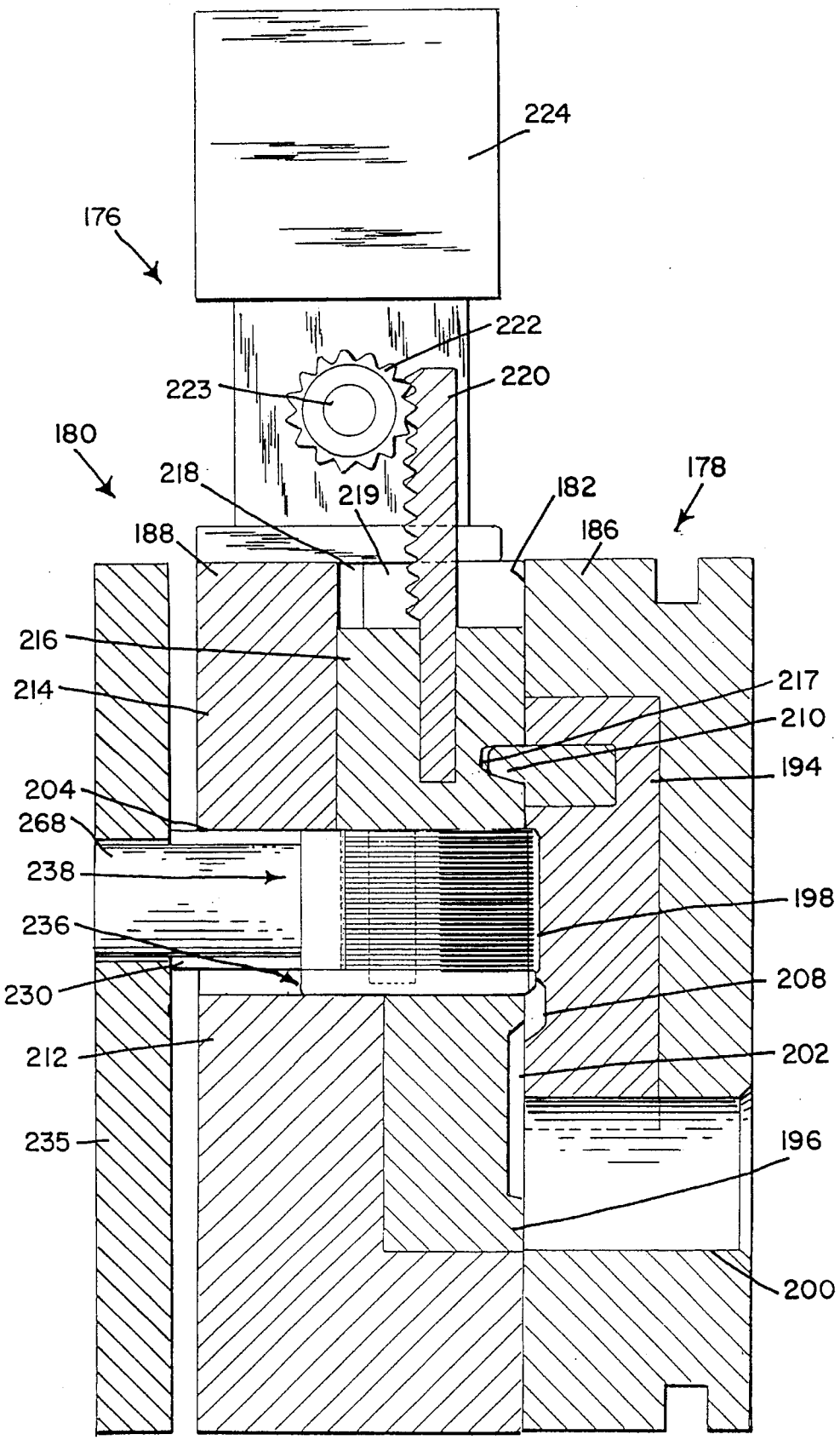
FIG. 30 is a view similar to FIG. 28 showing the ejector and cover halves of the die casting apparatus in the closed position.

Referring first to FIGS. 27–30, a third embodiment of a heat sink forming apparatus of the present invention consists of an injection die apparatus which is generally indicated by the reference numeral 176. Apparatus 176 comprises a first die member which is generally indicated by the reference numeral 178 and a second die member which is generally indicated by the reference numeral 180. The first die member 178 is the "cover half" of the die and the second die member 180 is the "ejector half" of the die. The first die member 178 or "cover half" of the die is normally stationary and the second die member 180 or "ejector half" of the die is mounted for movement toward and away from the first die member 178 by conventional supporting and driving apparatus, not shown, between an open position as shown in FIGS. 28 and 29 to a closed position as shown in FIG. 30. When the die apparatus 176 is in the open position, the opposing face surfaces 182 and 184 of the first and second die members 178 and 180, respectively, are spaced from one another. When the die apparatus 176 is in the closed position, the face surfaces 182 and 184 abut as shown, for example, in FIG. 30. The first die member 178 includes a plurality of guide pins 190 which extend from the face surface 182 for mating with a plurality of bushings 192 at the face surface 184 in the second die member 180.

The first die member 178 includes a conventional base portion 186 and a first cavity insert 194. The second die member 180 includes a base portion 188 and a second cavity insert 196. The first cavity insert 194 includes a cavity 198 at the face surface 182 and a runner portion 208 at the face surface 182 which is located just below the cavity 198. A bore 200 is located in the base 182 and it is operatively connected to conventional apparatus, not shown, for supplying molten metal to the bore during a die casting operation. The second cavity insert 196 includes a runner portion 202 at the face surface 184. When the first and second die members 178, 180, respectively, are in the closed position as shown in FIG. 30, the runner portion 202 is operatively connected to the bore 200 and to the runner portion 208 for enabling molten metal which is introduced into the bore 200 to flow through the runner portions 202 and 208 to the cavity 198. A horizontal socket 204 extends through the second cavity insert 196 and the base 188. The socket 204 is defined by a fixed bottom wall portion 212, a fixed top wall portion 214 in the base 188, a rectangular movable top wall portion 216 and a pair of movable side wall portions 228 and 230. The movable top wall portion 216 is slidably mounted within a rectangular bore 219 in the base 188 and in the second cavity insert 196 for vertical movement between an upper inactive position as shown in FIG. 29 to a lower active position as shown in FIG. 30. A toothed rack 220 is fixed to the movable wall portion 216 and is in driving engagement with a pinion 222. The pinion 222 is fixed to a drive shaft 223 which is rotatably driven by a dc gear driven stepping motor 224. The movable top wall portion 216 has an indent 217 which faces the first die member 178 for receiving a locking projection 210 which extends from the face surface 182 of the first cavity insert 194 when the movable wall portion 216 is in the lower or active position and the die apparatus 176 is in the closed position as shown in FIG. 30. An alignment/retainer plunger 226 is fixed to the movable wall portion 216 and extends downwardly from the lower end of the movable wall portion 216 toward the socket 204 when the movable wall portion 216 is in the upper or inactive position as shown in FIG. 29. When the movable wall portion 216 is in its lower or active position as shown in FIG. 28, the alignment/retainer plunger 226 extends into the socket 204 for engaging a plate cartridge 236 which has been inserted within the socket 204. The plate cartridge 236 forms part of the third embodiment of the present invention. The side wall 230 of the socket 204 is loosely mounted within the socket 204 of the second cavity insert 196 for horizontal movement toward and away from the side wall 228. The rear end of each of the side walls 228 and 230 are connected to an ejector plate 235. The ejector plate 235 is moved toward and away from the second die member 180 by an ejector plate drive mechanism (not shown). A piston 232 is fixed to the side wall 230 and extends through a horizontal bore 233 which is located in the base 188 and in the second cavity insert 196. The piston 232 is operatively connected to a hydraulic actuating mechanism which is generally indicated by the reference numeral 234 for moving the side wall 230 toward and away from the side wall 228.

Referring to FIGS. 31–38, the plate cartridge 236 includes an L-shaped holder which is generally indicated by the reference numeral 238 for supporting a plurality of spacing plates which are generally indicated by the reference numeral 256. Each spacing plate 256 is adapted for supporting a flat substantially rectangular fin plate 266. The fin plates 266 are substantially identical to the fin plates 45 and 146 of the first and second embodiment, respectively. The holder 238 includes a horizontal base portion 240 and a vertical back wall portion 242. The base portion 240 has a rearward upward horizontal surface 243 and a forward upward horizontal surface 244. The surface 244 is slightly lower than the surface 243 and is separated therefrom by a vertical transition surface 246. The rearward surface 243 contains a generally rectangular depression 248. The back wall portion 242 has a forwardly-facing vertical surface 250. The surface 250 includes a pair of forwardly extending flanges 252 which define therebetween a vertical slot 254.

Referring particularly to FIGS. 35–38, each spacing plate 256 includes a rear top surface 258 and a forward top surface 260. The surface 260 is lower than the surface 258 and is separated therefrom by a vertical transition surface 262. A forwardly extending tab 264 is located at the back end of the spacing plate 256. Each spacing plate 256 is adapted to receive a flat fin plate 266 which rests on the forward surface 260 and which abuts the transition surface 262.

Figure 31:
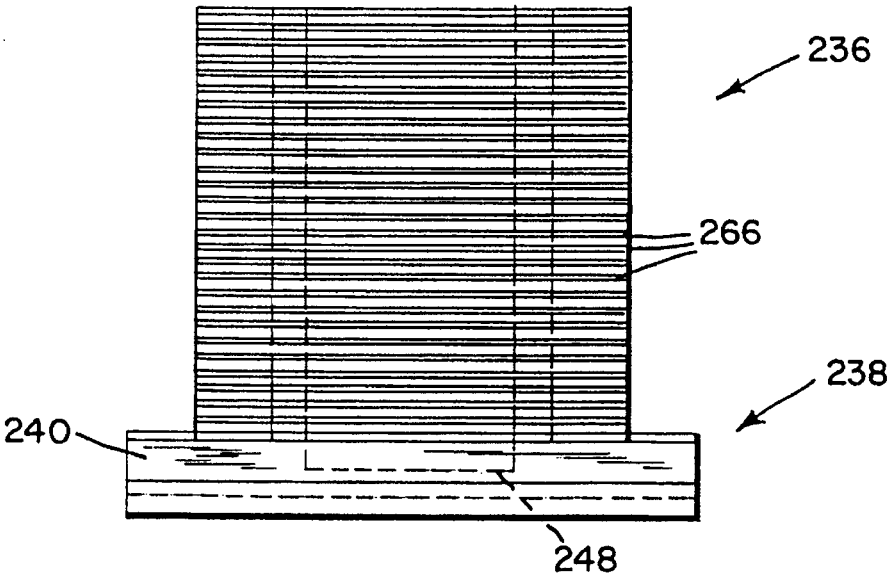
FIG. 31 is a front elevational view of the plate cartridge which forms part of the die casting apparatus of the present invention.
Figure 32:
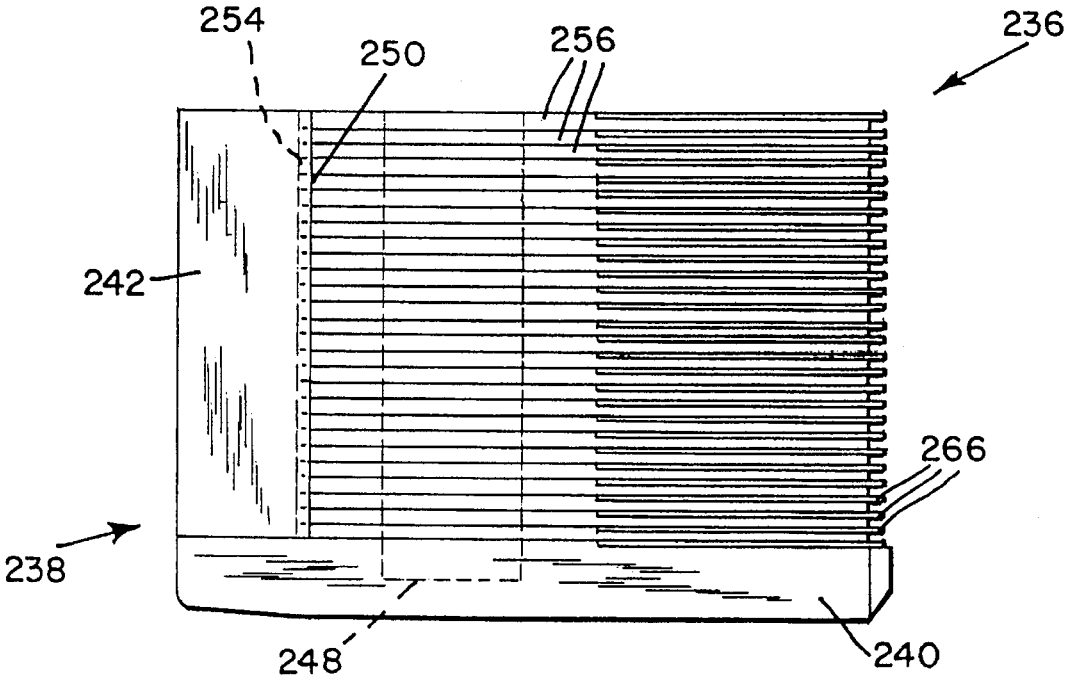
FIG. 32 is a side elevational view of the plate cartridge, looking in the direction of arrow XXXII of FIG. 31.
Figure 33:
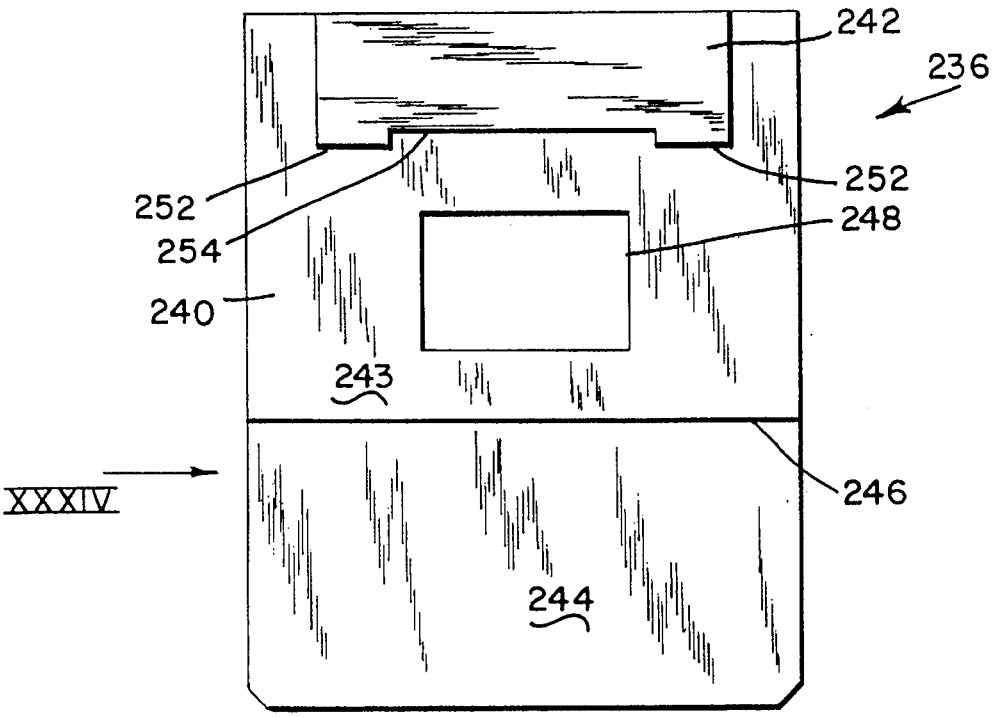
FIG. 33 is a top plan view of the holder portion of the plate cartridge.
Figure 34:
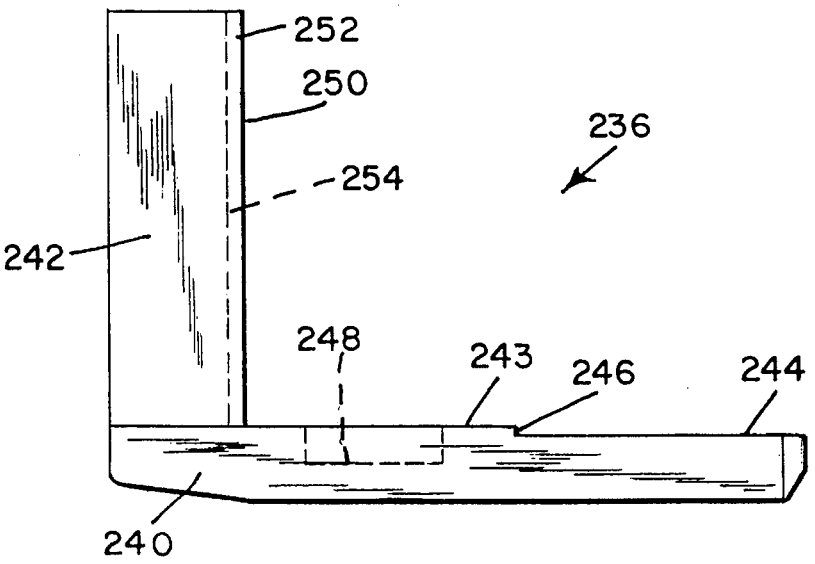
FIG. 34 is a side elevational view of the holder portion of the plate cartridge, looking in the direction of arrow XXXIV of FIG. 33.
Figure 35:
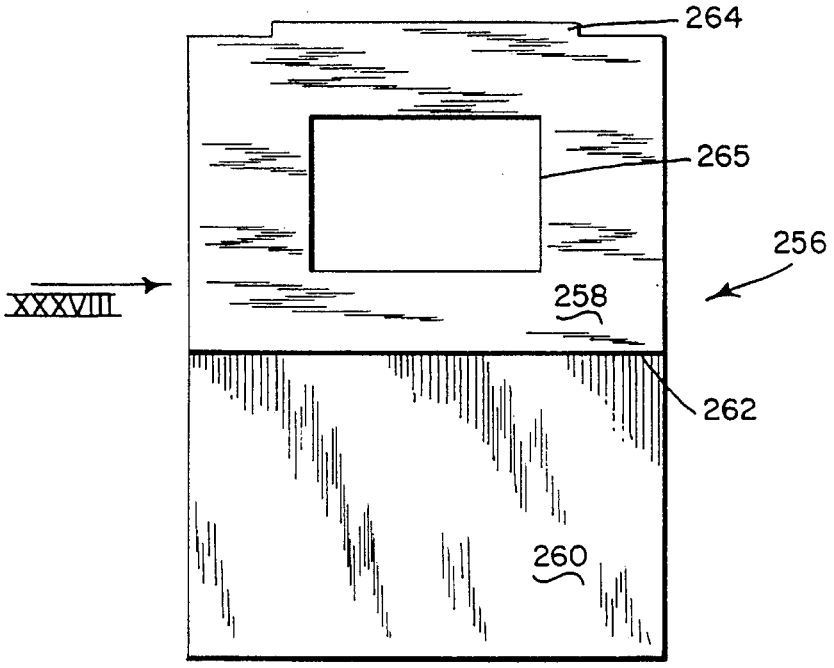
FIG. 35 is a top plan view of one of the spacing plates which forms part of the plate cartridge.
Figure 36:
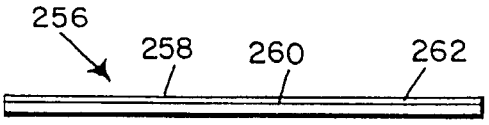
FIG. 36 is a front elevational view of the spacing plate of FIG. 35.
Figure 37:
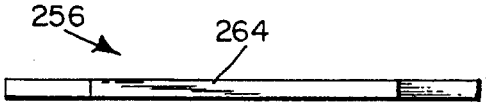
FIG. 37 is a rear elevational view of the spacing plate of FIG. 35.
Figure 38:
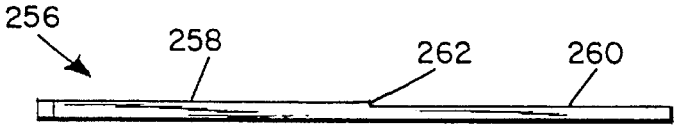
FIG. 38 is a side elevational view of the spacing plate looking in the direction of arrow XXXVIII of FIG. 35.

Referring particularly to FIGS. 31 and 32, the cartridge 236 is charged with spacing plates 256 and flat fin plates 266 by first placing a fin plate 266 on the surface 244 of the L-shaped holder 238 so that one edge of the fin plate abuts the transition surface 246. Thereafter, a plurality of spacers 256, each supporting a fin plate 266, are stacked on top of one another as shown in FIGS. 31 and 32. The tab 264 of each spacing plate 256 extends into the slot 254 of the holder 236 so that the aperture 265 of the spacing plate 256 is vertically aligned with the depression 248 in the holder. The forward end of each fin plate 266 extends freely beyond the spacing plates 256 as shown in FIG. 32.

After the holder 238 has been charged with spacing plates 256 and fin plates 266 to form the cartridge 236, the cartridge is inserted into the socket 204 of the second die member 180 when the die casting apparatus 176 is from the open position and the alignment/retainer plunger 226 is in its upper inactive position as shown in FIG. 29. Thereafter, the alignment/retainer plunger 226 is lowered by the stepping motor 224 so that it extends through the rectangular apertures of the spacing plates 256 and into the depression 248 of the holder 238 as shown in FIG. 28. The lowering of the alignment/retainer plunger 226 also causes the movable top wall portion 216 apply a vertical compressing force to the spacing plates 256 and fin plates 266. The hydraulic actuating mechanism 234 is actuated to cause the side wall 230 to apply a horizontal compressing force against the spacing plates 256 and fin plates 266. A horizontal support pillar 268 is secured by a retainer plate (not shown) and positioned to counteract all horizontal static and dynamic forces which are imparted to the holder 238. The first die member 178 is moved toward the second member 180 to the closed position, wherein the face surface 182 of the first die member 178 abuts the face surface 184 of the second die member 180. The projection 210 extends into the depression 217 to lock the movable top wall portion 216 in position and the free ends of the fin plates 266 extend into the cavity 198. A heat sink is formed by introducing molten metal into the bore 200 so that it travels to the cavity 198 by the runner portions 202 and 208. The molten metal fills the spaces between the fin plates 266. After the metal which has been injected into the cavity 198 has solidified, the second die member 180 is moved away from the first die member 178 to its first stop position. At this position, hydraulic cylinder 234 releases the vertical pressure via activating rod 232 to vertical holder 230. Concurrently, the dc stepping motor 224 rotates pinion 222, thus moving the rack 220 in the upwards position to release the horizontal pressure which is exerted by the top wall portion 216 upon the topmost lamination segment 256 and topmost fin plate 266. The dc motor 224 is actuated to lift the top wall portion 216 with attached alignment/retainer plunger 226 only sufficiently to relieve the pressure on the laminated stack while the plunger 226 is retained in the socket 248.

After the above sequence has been completed, the second die member 180 moves to its full open position. Thereafter, the ejector plate drive mechanism is actuated to move the side walls 228 and 230 forwardly within the socket 204 toward the first die member 178. The side walls 228 and 230 engage the side edges of the cast base of the heat sink and cause the heat sink to be ejected from the socket 204. Finally, the plate cartridge is removed from the socket 204 via a secondary mechanism (not shown). The fin plates 266 constitute the fins of the finished heat sink which are embedded in the metal which has been injected into the cavity 198 and which constitutes the base portion of the heat sink. The finished heat sink product of this embodiment is similar to that which is shown in FIGS. 9 and 10 for the first embodiment.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

What is claimed is:

1. A method of forming a unitary heat sink body for use in removal of heat from a heat generating electronic device, said body having a base and a plurality of spaced parallel fins extending from said base, said method comprising the following steps:

(a) supporting a first end of each of a plurality of flat plates in a row so that each plate is parallel to and spaced from adjacent plates and so that a second end of each of said plates which is opposite said first end extends freely;

(b) positioning the freely extending second ends of said row of plates in a substantially rectangular open cavity of a die casting mold;

(c) providing a seal between and around said plates at said cavity so that said cavity is completely closed by said seal and said plates;

(d) injecting molten metal into said cavity so that the free second end of each plate which is located within said cavity is completely surrounded by said molten metal;

(e) allowing said molten metal to solidify to form a rectangular base for supporting the second ends of said plates and thereby forming said unitary heat sink metal body having a base and projecting spaced parallel fins; and (f) removing said unitary heat sink metal body from said cavity.

2. A method of forming a unitary heat sink body as recited in claim 1, wherein said method further comprises forming apertures in the freely extending ends of each of said plates prior to insertion of said freely extending ends into the cavity of said mold, whereby, when molten metal is injected into said cavity, said apertures will be filled with said molten metal to form a mechanical lock between the base and the fins of the heat sink metal body when the injected molten metal solidifies.

3. A method of forming a unitary heat sink body as recited in claim 1, wherein the freely extending ends of said plates are inserted partially into said cavity so that the freely extending ends of the plates are spaced from the surface of the cavity which faces said freely extending ends to enable molten metal to completely surround the portions of said freely extending ends which are located within said cavity.

4. A method of forming a unitary heat sink body as recited in claim 1, wherein the dimensions of the cavity and the opening to the cavity in a plane which is parallel to said opposing surface is greater than that of said row of plates so that the base of the heat sink body which is produced by said method has an outwardly extending ledge about the outer periphery of said row of fins of the heat sink metal body.

5. A method of forming a unitary heat sink body as recited in claim 1, wherein the first ends of said plates are supported by a base assembly which has a fixed outer surface which faces the cavity of said mold and which engages said first ends and a plurality of spaced bars which extend between said plates to maintain said plates in a spaced relationship.

6. A method of forming a unitary heat sink body as recited in claim 5, wherein said method further comprises utilizing a base assembly which has a fixed intermediate surface which surrounds said row of plates and which faces said cavity, said intermediate surface and said bars being utilized to provide a seal at said cavity.

7. A method of forming a unitary heat sink body as recited in claim 6, wherein the first ends of said plates are supported by a base assembly which has a base element and a spacing and sealing plate, said spacing and sealing plate being located between said mold and said base element and spaced from said base element, said fixed outer surface being located in said base element and said intermediate surface and said spaced bars being located in said spacing and sealing plate.

8. A method of forming a unitary heat sink body as recited in claim 6, comprising the step of adjustably locating the spacing and sealing plate at different fixed positions between the mold and base element relative to the base element to utilize plates which have different dimensions between their first and second ends.

9. Apparatus for forming a unitary heat sink body for use in removal of heat from a heat generating electronic device, said heat sink body having a generally rectangular base and a plurality of spaced parallel fins extending from said base, said apparatus comprising:

(a) supporting apparatus for supporting a plurality of generally rectangular flat plates of a heat conductive and heat dissipating material in a fixed position so that the plates are spaced and parallel and each plate has a freely extending end;

(b) a die cast mold which has a cavity and a generally rectangular opening to the cavity, said die cast mold being movable toward and away from the free ends of said plates between an inactive position in which the mold is substantially spaced from the plates and an active position in which the free ends of the plates extend into the cavity of the mold, said die cast mold having an aperture for enabling molten metal to be injected into said cavity; and (c) sealing means for sealing the opening to said cavity around and between said plates so that when molten metal is injected into said cavity, the molten metal will enter the spaces between the free ends of the plates within the cavity for forming said base and for supporting said plates when the molten metal solidifies.

10. Apparatus for forming a unitary heat sink body as recited in claim 9, wherein width and length dimensions of said cavity and the opening to said cavity is greater than the length and width dimensions of said row of flat plates so that the base which is formed in said cavity has an outwardly extending ledge about the outer periphery of the fins which are formed from said plates.

11. Apparatus for forming a heat sink body as recited in claim 9, wherein said flat plates are metal.

12. Apparatus for forming a unitary heat sink body as recited in claim 9, wherein said supporting apparatus comprises:

(a) a fixed base which has a flat surface which faces said rectangular opening to the cavity of said die cast mold for engaging a first edge of each of said plates; and (b) a spacing plate for maintaining said flat plates on said flat surface in said spaced parallel relationship so that the free ends of said flat plates face the cavity of said mold.

13. Apparatus for forming a unitary heat sink body as recited in claim 12, wherein said sealing means comprises a sealing surface on said spacing plate which faces said rectangular opening, said sealing surface being located between said flat plates and around the periphery of said plurality of flat plates so that said rectangular opening is completely closed by said flat plates and said sealing surface when the free ends of said flat plates are located within said cavity.

14. Apparatus for forming a unitary heat sink body as recited in claim 12, wherein said apparatus further comprises:

(a) a fixed frame which is fixed relative to said fixed base, said spacing plate being mounted on said fixed frame for movement toward and away from said opposing surface; and (b) drive means operatively connected to said spacing plate for adjustably positioning said spacing plate relative to said opposing surface.

15. Apparatus for forming a unitary heat sink body as recited in claim 14, wherein said die cast mold is mounted on said fixed frame for movement toward and away from said opposing surface.

16. A method of forming a unitary heat sink body for use in removal of heat from a heat generating electronic device, said body having a base and a plurality of spaced fins which extend from the base, said method comprising the following steps:

(a) providing a first die member having a first face surface which contains a cavity;

(b) providing a second die member having a second face surface which has a socket which faces said cavity;

(c) interleaving a plurality of spacing plates with a plurality of fin plates so that one end of each fin plate extends freely beyond the spacing plates to form a plate cartridge in which fin plates alternate with spacer plates and said fin plates are aligned in a row, said fin plates being parallel and spaced from one another;

(d) inserting the plate cartridge within the socket so that said one end of each fin plate extends toward said cavity;

(e) moving one of said first and second die members toward the other of said first and second die members so that said first and second face surfaces abut and said one end of each fin plate extends into said cavity;

(f) injecting molten metal into said cavity so that said one end of each fin plates which is located within said cavity is completely surrounded by said molten metal;

(g) allowing said molten metal to solidify to form a base for supporting said one end of said fin plates and thereby forming a unitary heat sink body having a base and projecting spaced parallel fins; and (h) removing said unitary heat sink metal body from said cavity.

17. A method of forming a unitary heat sink body as recited in claim 16, wherein said method further comprises:

(a) applying clamping pressure to said fin plates along the plane of each fin plate and parallel to the first face surface when the fin plates are located within the socket of the second die member; and (b) applying clamping pressure to said fin plates transversely to the plane of each fin plate when the fin plates are located within the socket of the second die member.

18. A method of forming a unitary heat sink body as recited in claim 16, wherein the fin plates and the spacing plates in the plate cartridge are vertical when the cartridge is inserted within the socket of the second die member.

19. A method of forming a unitary heat sink body as recited in claim 16, wherein the fin plates and the spacing plates in the plate cartridge are horizontal when the cartridge is inserted within the socket of the second die member.

20. An injection die apparatus for forming a unitary heat sink body for use in removal of heat from a heat generating electronic device, said heat sink body having a base and a plurality of spaced parallel fins extending from said base, said injection die comprising:

(a) a first die member having a first face surface which contains a cavity;

(b) a second die member having a second face surface which faces said first face surface, said second face surface having a socket which faces said cavity;

(c) fin spacing and retaining means for maintaining a plurality of flat fin plates within said socket so that the fin plates are spaced in a row and so that each of said fin plates has a free end which extends beyond said second face surface toward said cavity; and (d) one of said first and second die members being movable toward and away from the other of said first and second die members between an open position in which said first and second face surfaces are spaced from each other and a closed position in which said first and second face surface abut, said fins being insertable within said socket when said die members are in said open position so that when said die members are in said closed position, the free end of said fin plates extend into said cavity and said cavity is sealed by said second face surface and said fin spacing and retaining means, for enabling molten metal to be injected into said cavity and so that said molten metal enters the spaces between said fin plates to form said base for supporting said fin plates when said molten metal is allowed to solidify.

21. An injection die apparatus as recited in claim 20, wherein said die apparatus further comprises:

(a) first clamping means for applying pressure to said fin plates along the plane of each of said fin plates and parallel to said first face surface when said fin plates are located within said socket; and (b) second clamping means for applying pressure to said fin plates transversely to the plane of each of said fin plates when said fin plates are located within said socket.

22. An injection die apparatus as recited in claim 21, wherein each of said first and second clamping means comprises:

(a) a first side wall of said socket;

(b) a second side wall of said socket which is mounted within said second die member for movement toward and away from said first side wall;

(c) biasing means for urging said second side wall away from said first side wall; and (d) actuating means for moving said second side wall toward said first side wall against the bias of said biasing means.

23. An injection die apparatus as recited in claim 22, wherein said second side wall has an inner surface which faces said first side wall and an outer surface which faces away from said first side wall, said second face surface having an indent adjacent the outer surface of said second side wall and, wherein said actuating means comprises a projection on said first die member which extends toward said indent for engaging the outer surface of said second side wall and for moving said second side wall toward said first side wall when one of said first and second die members is moved to its closed position.

24. An injection die apparatus as recited in claim 20, wherein said fin spacing and retaining means comprises a cartridge for holding a plurality of fin plates so that the fin plates are spaced from one another and arranged in a row and the free ends of said fin plates extend beyond a first end of said cartridge, said cartridge having a second end which is opposite said first end, said socket being adapted to receive the second end of said cartridge.

25. An injection die apparatus as recited in claim 24, wherein said cartridge comprises:

(a) a plurality of spacing plates, each of said spacing plates having a first end edge at a first end of the spacing plate and a second end edge at a second end of the spacing plate which is opposite said first end edge, each of said spacing plates being adapted to retain one of said fin plates so that the free end of the fin plate extends beyond said second end edge; and (b) holding means for aligning and connecting said spacing plates in a parallel stack so that said fin plates are parallel and aligned and spaced from one another in a row.

26. An injection die apparatus as recited in claim 25, wherein each of said spacing plates having a relatively thick portion adjacent said second end edge and a relatively thin portion adjacent said first end edge, said relatively thick and thin portions being separated by a transition surface which faces toward said first end edge, said fin having a broad side end, an end edge which is opposite said free end, said relatively thin portion being adapted to engage the broad side of one of said fin plates so that the end edge of said fin plates engages said transition surface, the combined thickness of one of said fin plates and the relatively thin portion of one of said spacing plates being equal to the thickness of the relatively thick portion of one of said spacing plates.

27. An injection die apparatus as recited in claim 26, wherein said holding means comprises at least one aperture in the relatively thick portion of each of said spacing plates and at least one retaining pin for extending through the apertures in said spacing plates.

28. An injection die apparatus as recited in claim 27, wherein said cartridge further comprises an end plate which abuts the last exposed fin plate in said row of fin plates which are combined with said spacing plates.

29. An injection die apparatus as recited in claim 25, wherein the second end edge of each of said spacing plates has a first profile configuration and said socket has an inner wall which is complementary with said first profile configuration.

30. An injection die apparatus as recited in claim 29, wherein one of said first and second profile configurations includes at least one projecting portion and the other of said first and second profile configurations includes at least one complementary recess portions.

31. An injection die apparatus as recited in claim 25, wherein said cartridge comprises:

(a) a plurality of spacing plates, each of said spacing plates having a first end edge at a first end of the spacing plate and a second end edge at a second end of the spacing plate which is opposite said first end edge, each of said spacing plates being adapted to retain one of said fin plates so that the free end of the fin plate extends beyond said second end edge, said spacing plates being interleaved with said fin plates; and (b) a holder for supporting and aligning said spacing plates, said holder having a horizontal base for supporting said spacing plates and said fin plates and a vertical end wall which is fixed to said base, said end wall having a vertical alignment surface for engaging the first end edge of each of said spacing plates.

32. An injection die apparatus as recited in claim 31, wherein said second die member further comprises compression means for selectively compressing said cartridge transversely of the broad sides of said fin plates and said spacing plates.

33. An injection die apparatus as recited in claim 31, wherein each of said spacing plates has a relatively thick portion adjacent said second end edge and a relatively thin portion adjacent said first end edge, said relatively thick and thin portions being separated by a transition surface which faces toward said first end edge, said fin having a broad side end, an end edge which is opposite said free end, said relatively thin portion being adapted to engage the broad side of one of said fin plates so that the end edge of said fin plates engages said transition surface, the combined thickness of one of said fin plates and the relatively thin portion of one of said spacing plates being equal to the thickness of the relatively thick portion of one of said spacing plates.

34. An injection apparatus as recited in claim 33, wherein the relatively thick portion of each of said spacing plates has at least one aperture so that when all of said spacing plates are aligned and supported on said horizontal base, the apertures for all of the spacing plates are aligned to define a bore and wherein said second die member further comprises:

(a) a plunger which is mounted within said second die member for axial movement from an inactive position outside of said socket to an active position within said socket so that said plunger extends into the bore which is formed by the apertures in said spacing plates when the plunger is moved from its inactive position to its active position after said cartridge has been inserted within said socket; and (b) drive means for moving said plunger between said active and inactive positions.

35. An injection die apparatus as recited in claim 31, wherein the second end edge of each of said spacing plates has a first profile configuration and said alignment surface has a second profile configuration which is complementary with said first profile configuration.

36. An injection die apparatus as recited in claim 35, wherein one of said first and second profile configurations includes at least one projecting portion and the other of said first and second profile configurations includes at least one complementary recess portion.

37. An injection apparatus as recited in claim 36, wherein the aperture in each of said spacer plates is rectangular and said plunger is rectangular in cross-section.

38. An injection apparatus as recited in claim 36, wherein said base has an upper surface for supporting said spacer plates and fin plates and said upper surface has a depression which is vertically aligned with said bore for receiving said plunger.

39. An injection apparatus as recited in claim 38, wherein said depression and the aperture in each of said spacer plates are rectangular and said plunger is rectangular in cross-section.

40. Apparatus for forming a unitary heat sink body for use in removal of heat from a heat generating electronic device, said heat sink body having a generally rectangular base and a plurality of spaced parallel fins extending from said base, said apparatus comprising:

(a) supporting apparatus for supporting a plurality of generally rectangular flat fin plates of a heat conductive and heat dissipating material in a fixed position so that the plates are parallel and spaced from one another and each fin plate has a freely extending end;

(b) a die cast mold which has a cavity and a generally rectangular opening to the cavity which faces the free ends of said fin plates;

(c) one of said die cast mold and said supporting apparatus being movable toward and away from the other of said die cast mold and said supporting apparatus between an inactive position in which the die cast mold is substantially spaced from said fin plates and an active position in which the fee ends of said fin plates extend into said cavity, said die cast mold having a passageway which leads to said cavity for enabling molten metal to be injected into said cavity; and (d) sealing means for sealing the opening to said cavity around and between said fin plates so that when molten metal is injected into said cavity, the molten metal will enter the spaces between the free ends of the plates within the injection cavity for forming said base and for fixing said fin plates to the base when said molten metal solidifies.

* * * * *